US011104535B2

(12) United States Patent
Waki et al.

(10) Patent No.: US 11,104,535 B2
(45) Date of Patent: Aug. 31, 2021

(54) MEDIUM PROCESSING APPARATUS

(71) Applicant: SEIKO EPSON CORPORATION, Tokyo (JP)

(72) Inventors: Shingo Waki, Shiojiri (JP); Kazuhiro Hashii, Matsumoto (JP); Satoshi Nakata, Matsumoto (JP); Fumiaki Akahane, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 175 days.

(21) Appl. No.: 16/358,502

(22) Filed: Mar. 19, 2019

(65) Prior Publication Data

US 2019/0291986 A1 Sep. 26, 2019

(30) Foreign Application Priority Data

Mar. 20, 2018 (JP) ..... JP2018-052144

(51) Int. Cl.

| | |
|---|---|
| ***B65H 5/38*** | (2006.01) |
| ***B65H 5/00*** | (2006.01) |
| ***B65H 27/00*** | (2006.01) |
| ***B41J 11/057*** | (2006.01) |

(52) U.S. Cl.

CPC ..... *B65H 5/38* (2013.01); *B41J 11/057* (2013.01); *B65H 5/004* (2013.01); *B65H 27/00* (2013.01); *B65H 2301/5132* (2013.01); *B65H 2301/5321* (2013.01); *B65H 2301/5322* (2013.01); *B65H 2401/211* (2013.01); *B65H 2401/212* (2013.01); *B65H 2404/5331* (2013.01); *B65H 2515/702* (2013.01)

(58) Field of Classification Search

CPC .. B65H 5/004; B65H 5/38; B65H 2301/5132; B65H 2301/5133; B65H 2301/5321; B65H 2301/5322; B65H 2401/111; B65H 2401/1121; B65H 2401/113; B65H 2401/21; B65H 2401/211; B65H 2401/212; B65H 2404/533; B65H 2404/5331; B65H 2515/70; B65H 2515/702; B65H 2515/708; B65H 2515/716; B41J 11/057

See application file for complete search history.

(56) References Cited

U.S. PATENT DOCUMENTS

| | | | | |
|---|---|---|---|---|
| 5,689,794 | A * | 11/1997 | Kondo | B65H 5/38 399/381 |
| 6,347,214 | B1 * | 2/2002 | Kaneko | B65H 29/56 399/315 |
| 2017/0205749 | A1 * | 7/2017 | Adaniya | B65H 5/38 |

FOREIGN PATENT DOCUMENTS

| | | | |
|---|---|---|---|
| JP | 2000-289291 | A | 10/2000 |
| JP | 2011-042443 | A | 3/2011 |
| JP | 2013-023365 | A | 2/2013 |
| JP | 2017-179094 | A | 10/2017 |

* cited by examiner

*Primary Examiner* — Prasad V Gokhale
(74) *Attorney, Agent, or Firm* — Workman Nydegger

(57) ABSTRACT

A printer as a medium processing apparatus includes a transport path through which a paper being transported passes, a recording head that records on the paper on the transport path, and a platen that forms at least a portion of the transport path as a path forming member with which the paper comes into contact, in which a surface resistance value of the path forming member changes according to an applied voltage of the medium.

17 Claims, 18 Drawing Sheets

MEDIUM PROCESSING APPARATUS

CROSS REFERENCES TO RELATED APPLICATIONS

The entire disclosure of Japanese Patent Application No. 2018-052144, filed Mar. 20, 2018 is expressly incorporated by reference herein.

BACKGROUND

1. Technical Field

The present disclosure relates to a medium processing apparatus that performs processing on a medium being transported.

2. Related Art

As a medium processing apparatus that performs processing on a medium being transported, for example, there are a recording apparatus that performs recording processing on a medium being transported, and an image reading apparatus that reads an image of a medium being transported.

In such a medium processing apparatus, if a medium is transported, static electricity may be generated when the medium passes through a transport path. If the medium is charged, an electric field may be generated between a support surface side supporting the medium on the transport path and an opposed surface side opposed to the support surface.

If the electric field is generated on the transport path, paper dust coming out of a paper as a medium may be attracted and adhered to the transport path surface due to the influence of the electric field to cause various problems.

For example, in an ink jet printer as an example of the recording apparatus, when electrolysis occurs between a recording head ejecting ink from a nozzle and a medium support unit supporting the medium below the recording head, paper dust attracts to the recording head, clogging of the nozzle occurs, and thus there is a possibility that the ink may not be ejected properly.

In addition, in a scanner as an example of the medium reading apparatus, when an electric field is generated on the transport path in a vicinity of the reading unit, paper dust attracts to a reading surface of the reading unit and adheres to the reading surface, and thus there is a possibility that a read image may be affected.

Although the above-described problems can be suppressed by disposing a charge eliminating member such as a charge eliminating brush or a charge eliminating cloth on an upstream side or a downstream side of a platen (medium support member) to charge-eliminate the medium, when the charge eliminating member is used, a stable charge elimination performance cannot be obtained because the distance between the charge eliminating member and the medium fluctuates. Furthermore, if the charge eliminating member is brought too close to the medium so as to enhance the charge elimination performance, the surface of the medium may be damaged.

In order to stably charge-eliminate without damaging the medium, for example, in the recording apparatus, although the medium support unit is formed of a metal having conductivity, as shown in JP-A-2013-23365, a metal rib having conductivity is provided on a platen formed of a resin, and a metal portion is grounded. Therefore, it is performed to charge-eliminate the charges charged on the medium being transported on the platen.

Here, the inventors of the disclosure found electrical characteristics more suitable for suppressing the above-described problems, and unit for realizing the same.

SUMMARY

An advantage of some aspects of the disclosure is to more appropriately charge-eliminate a medium in a medium processing apparatus that performs processing on a medium being transported.

According to an aspect of the disclosure, there is provided a medium processing apparatus including a transport unit that transports a medium, a transport path through which the medium being transported by the transport unit passes, a processing unit that performs predetermined processing on the medium on the transport path, and a path forming member that forms at least a portion of the transport path, and with which the medium is in contact, in which a surface resistance value of the path forming member changes according to an applied voltage of the medium.

In the medium processing apparatus, the path forming member may have such a property that a surface resistance value in a case where a first voltage is applied is larger than a surface resistance value in a case where a second voltage higher than the first voltage is applied.

In a case where a second voltage higher than the first voltage is applied, it corresponds to a case where the charged medium is in sliding contact with the path forming member (medium is passing over path forming member). In a case where the first voltage lower than the second voltage is applied, it corresponds to a case where the medium does not come into sliding contact with the path forming member (after the medium has passed over the path forming member).

That is, the surface resistance value in the case where the second voltage is applied corresponds to the surface resistance value in a state where the charged medium is in sliding contact with the path forming member. The surface resistance value in the case where the first voltage is applied corresponds to the surface resistance value in a state where the medium has passed and does not in contact with the path forming member.

The smaller the surface resistance value is, the more rapidly the charge elimination of the charged medium can be performed.

With this configuration, the path forming member has such a property that the surface resistance value in the case where the first voltage is applied is higher than the surface resistance value in the case where the second voltage higher than the first voltage is applied. Therefore, with the small surface resistance value in the case where the charged medium comes into sliding contact with the path forming member (corresponding to the case of applying the second voltage), the charge elimination of the medium can be performed rapidly.

Incidentally, in the vicinity of the path forming member for charge-eliminating the medium, there is a case that the medium powder dropped from the medium (for example, paper dust in a case where the medium is paper) remains even after the medium has passed. The medium powder dropped from the medium before charge elimination is charged.

For example, if the path forming member made of a metal as in the related art is used, the surface resistance value does not change at a small value even when the charged medium passes (high voltage) or after passing through the medium (low voltage). Therefore, the charged medium powder is rapidly charge-eliminated, but the charge-eliminated medium powder is likely to float, and there is a possibility that the floating medium powder may affect the processing by the processing unit.

On the other hand, the path forming member has such a property that the surface resistance value in the case where the first voltage is applied (corresponding to the state after the medium has passed over the path forming member) is higher than the surface resistance value in the case where the second voltage higher than the first voltage is applied (corresponding to the state where the medium is passing over the path forming member). Therefore, the charged medium powder is unlikely to be charge-eliminated, and is likely to keep charged state of low voltage for a while. The medium powder charged in the low voltage state can be adsorbed by attracting to the path forming member by electrostatic attraction.

As described above, since the charge elimination of the medium is rapidly performed while the charged medium passes over the path forming member, and the medium powder remaining in a vicinity of the path forming member after passing through the medium is likely to be adsorbed by the path forming member, it may be said that the medium can be more suitably charge-eliminated.

In the medium processing apparatus, a surface resistance value of the path forming member in a case where the voltage is not applied is larger than a surface resistance value in a case where a voltage is applied.

With this configuration, the same action and effect as in the above configuration can be obtained.

In the medium processing apparatus, a surface resistance value of the path forming member in a state where the charged medium passes and does not come into contact is larger than a surface resistance value in a state where the charged medium passes while being in contact.

With this configuration, the same action and effect as in the above configuration can be obtained.

In the medium processing apparatus, a rate of change of a surface resistance value of the path forming member which increases in a case where an applied voltage is changed from a first voltage to zero is higher than a rate of change of a surface resistance value which increases in a case where the applied voltage is changed from a second voltage higher than the first voltage to the first voltage.

With this configuration, the same action and effect as in the above configuration can be obtained.

In the medium processing apparatus, the path forming member may be formed of a resin material containing carbon nanotubes in a range of 2 wt % or more and less than 6 wt %.

With this configuration, since the path forming member is formed of a resin material containing carbon nanotubes in a range of 2 wt % or more and less than 6 wt %, it is possible to more effectively obtain the same action and effect as that of any of the above configurations.

According to another aspect of the disclosure, there is provided a medium processing apparatus a transport unit that transports a medium, a transport path through which the medium being transported by the transport unit passes, a processing unit that performs predetermined processing on the medium on the transport path, a path forming member that is formed of a metal having conductivity, forms at least a portion of the transport path, and with which the medium is in contact, and a ground member that grounds the path forming member to a ground, in which the ground member includes a relay member, and a surface resistance value of the relay member changes according to an applied voltage of the medium.

In the medium processing apparatus, the ground member may include a relay member, and a surface resistance value of the relay member in a case that a first voltage is applied is larger than a surface resistance value in a case that a second voltage higher than the first voltage is applied.

With this configuration, the ground member includes the relay member having a property that the surface resistance value in the case where the first voltage is applied is higher than the surface resistance value in the case where the second voltage higher than the first voltage is applied. Therefore, the path forming member can have such a property that the surface resistance value in the case where the first voltage is applied is higher than the surface resistance value in the case where the second voltage higher than the first voltage is applied, and the same action and effect as in the above configuration can be obtained.

In the medium processing apparatus, the ground member may include a relay member, and a surface resistance value of the relay member in a case where the voltage is not applied is larger than a surface resistance value in a case where the voltage is applied.

With this configuration, the ground member includes the relay member, and the surface resistance value of the relay member in the case where the voltage is not applied is higher than the surface resistance value in the case where the voltage is applied. Therefore, the path forming member can made to have such a property that the surface resistance value in the case where the voltage is not applied is higher than the surface resistance value in the case where the voltage is applied, and the same action and effect as in the above configuration can be obtained.

In the medium processing apparatus, the ground member may include a relay member, and a surface resistance value of the relay member in a state where the charged medium passes and does not come into contact with the path forming member is larger than a surface resistance value in a state where the charged medium passes while being in contact with the path forming member.

With this configuration, the ground member includes the relay member having a property that the surface resistance value in the state where the charged medium passes and does not come into contact with the path forming member is larger than the surface resistance value in the state where the charged medium passes while being in contact with the path forming member. Therefore, the path forming member can made to have such a property that the surface resistance value in the state where the charged medium passes and does not come into contact with the path forming member is larger than the surface resistance value in the state where the charged medium passes while being in contact with the path forming member, and the same action and effect as in the above configuration can be obtained.

In the medium processing apparatus, the ground member may include a relay member, and a surface resistance value of the relay member which increases in a case where an applied voltage is changed from a first voltage to zero is higher than a rate of change of a surface resistance value which increases in a case where the applied voltage is changed from a second voltage higher than the first voltage to the first voltage.

With this configuration, the path forming member formed of a metal having conductivity can made to have such a property that the rate of change of the surface resistance value which increases in the case where the applied voltage is changed from the first voltage to zero is higher than the rate of change of the surface resistance value which increases in the case where the applied voltage is changed from the second voltage higher than the first voltage to the first voltage, and the operation and effect of the above configuration can be more effectively obtained.

In the medium processing apparatus, the relay member may be formed of a resin material containing carbon nanotubes in a range of 2 wt % or more and less than 6 wt %.

With this configuration, since the relay member is formed of a resin material containing carbon nanotubes in a range of 2 wt % or more and less than 6 wt %, the same operation and effect as that of any of the above configurations can be more effectively obtained.

In the medium processing apparatus, there is provided a medium placement unit on which the medium fed toward the processing unit by the transport unit is placed, in which the path forming member forms at least a portion of the transport path from the medium placement unit to the processing unit.

With this configuration, since the path forming member forms at least a portion of the transport path from the medium placement unit to the processing unit, the same operation and effect as that of any of the above configurations can be obtained in the transport path on the upstream side of the processing unit.

In the medium processing apparatus, the processing unit may be a recording unit that performs recording on the medium, and the path forming member may be a support member that supports the medium at a position facing the recording unit.

With this configuration, in the recording apparatus in which the processing unit is a recording unit that performs recording on the medium, and the path forming member is a support member that supports the medium at a position facing the recording unit, the same operation and effect as that of any of the above configurations can be obtained.

In particular, in the case where the processing unit is a recording unit for recording on the medium, if the medium powder adheres to the recording unit, although the recording quality is reduced, in this embodiment, it is possible to suppress the floating of the medium powder in the vicinity of the recording unit, and to reduce the possibility of deterioration in the recording quality.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

First Embodiment

Figure 1:
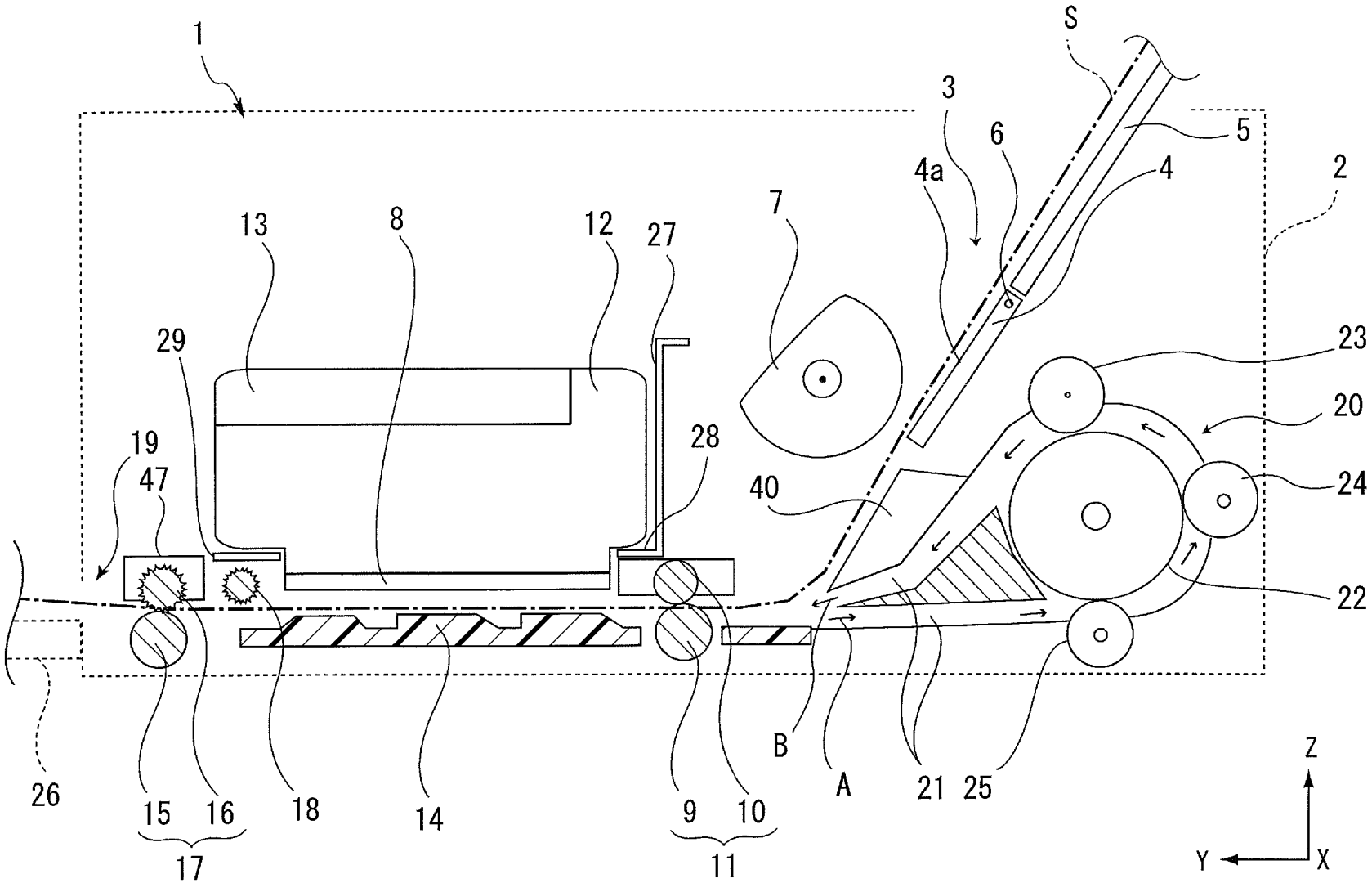
FIG. 1 is a schematic cross-sectional view showing an example of a printer according to the disclosure.

As an example of a medium processing apparatus according to the disclosure, an ink jet printer (recording apparatus) is taken as an example. Hereinafter, an outline of an ink jet printer 1 (hereinafter referred to as printer 1) will be described with reference to the drawings.

Incidentally, in the X-Y-Z coordinate system shown in each drawing, the X direction is a width direction of the recording apparatus and is a scanning direction of a recording head. The Y direction is a depth direction of the recording apparatus, and is a transport direction of a paper as a medium. The Z direction is a direction of gravity and indicates a height direction of the recording apparatus.

In addition, the +Y direction is a front side of the apparatus, and the −Y direction side is a rear side of the apparatus. In addition, the +Z direction is referred to as upward (including upper portion and upper surface), and the −Z direction is referred to as downward (including lower portion and lower surface).

The direction where the paper is transported in the printer 1 is referred to as "downstream", and the direction opposite thereto is referred to as "upstream".

About Printer Overview

The outline of the printer 1 will be described with reference to FIG. 1. Incidentally, in FIG. 1, transport path S of the paper is indicated by a chain line.

The printer 1 is provided with a housing 2 forming a main body of the printer 1, and on the −Y direction side serving as a rear surface side of the housing 2, a medium setting unit 3 capable of setting a plurality of sheets is provided. The medium setting unit 3 is provided with a hopper 4 as a "medium placement unit" for placing the paper to be fed toward a recording head 8 by a feeding roller 7 described later, and a paper support 5. The leading edge side of the paper is supported by a support surface 4*a* of the hopper 4 in an inclined attitude. A trailing edge side of the paper not supported by the hopper 4 is supported by a paper support 5 provided on the upstream side of the hopper 4 in the paper transport direction.

The feeding roller 7 is provided at a position opposed to the support surface 4*a* of the hopper 4. In the hopper 4, with a swing shaft 6 extending in the X axis direction on the upstream side in the medium transport direction as an axis, the support surface 4*a* of the paper is provided so as to be able to swing and move forward and backward with respect to the feeding roller 7, and is pressed against the feeding roller 7 by a pressing member (not shown).

The feeding roller 7 is a "transport unit" that feeds the paper toward the recording head 8 as a "processing unit" that performs predetermined processing on the paper. Incidentally, the recording head 8 is a "recording unit" that performs recording on the paper as predetermined processing.

If the support surface 4*a* of the hopper 4 swings in the direction approaching the feeding roller 7, the uppermost paper among the papers placed on the hopper 4 comes into contact with the feeding roller 7. If the feeding roller 7 rotates, the papers are picked up one by one and fed toward the downstream in the transport direction.

The paper fed from the upstream side in the transport direction is transported to a recording position below the recording head 8 by a pair of transport rollers 11 formed of a transport driving roller 9 and a transport driven roller 10. The pair of transport rollers 11 is also a "transport unit" feeding the paper toward the recording head 8.

In the embodiment, the recording head 8 is an ink jet type head that performs recording by ejecting ink, which is liquid, onto the paper.

The recording head 8 is provided on a carriage 12. The carriage 12 is capable of mounting an ink cartridge 13 for supplying ink to the recording head 8, receives a power from a drive source (not shown), and can reciprocate in a direction intersecting the transport direction (+Y direction) of the paper, that is, a paper width direction (X axis direction).

Figure 2:
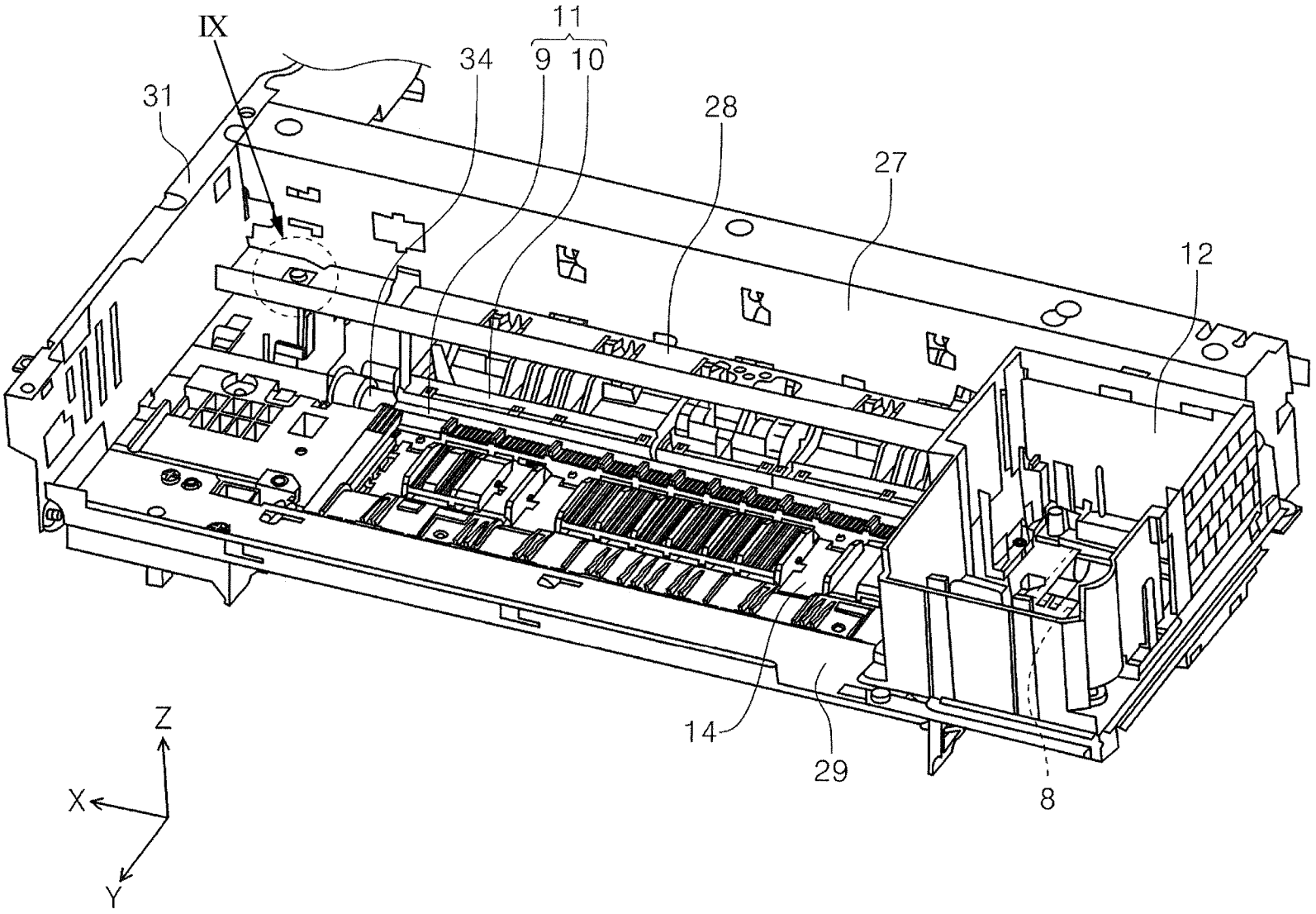
FIG. 2 is a perspective view showing a main part of the printer.

The carriage 12 is supported on a guide rail 28 of a main frame 27 extending in the width direction (X axis direction) intersecting the medium transport direction on the rear surface side (−Y direction side) of the apparatus, and is supported by a guide frame 29 on the front surface side (+Y direction side) of the apparatus (refer to also FIG. 2). In FIG. 2, reference numeral 31 is one of side frames provided on both sides in the width direction of the main frame 27. The description of the side frame on the −X direction side is omitted in FIG. 2.

Returning to FIG. 1, below the recording head 8, a platen 14 as a "path forming member" is provided, which forms at least a portion of the transport path S and with which the paper is in sliding contact. The platen 14 is a "support member" that supports the paper at a position facing the recording head 8 and defines a gap between an ink ejection surface of the recording head 8 and the paper.

Recording is performed by ejecting ink from the recording head 8 onto the paper transported while being supported by the platen 14.

On the downstream side of the recording head 8, a pair of discharge rollers 17 including a discharge driving roller 15 and a discharge driven roller 16 is provided. The paper after recording is discharged by the pair of discharge rollers 17 toward the front surfaces of the apparatus from a paper discharge unit 19 formed on the front surface of the apparatus.

Incidentally, the regulating roller 18 provided on the upstream side of the discharge driven roller 16 is a roller that regulates the paper from floating on the upstream side of the discharge driven roller 16.

The discharge driven roller 16 and the regulating roller 18 are formed as a toothed roller having teeth on the outer circumference.

In addition, the printer 1 is provided with a reversing mechanism 20 of the paper, and is configured to be capable of recording on both sides of the paper. The reversing mechanism 20 is positioned on the rear surface side of the support surface 4*a* of the hopper 4, and is provided with a reversing roller 22 for reversing the paper recorded by the recording head 8, and a plurality of driven rollers (first driven roller 23, second driven roller 24, and third driven roller 25) biased against the reversing roller 22 and driven to rotate.

In a case where printing is performed on both sides of the paper in the printer 1, after printing is performed on a first surface of the paper by the recording head 8, the side of the paper which is the trailing edge of the paper is returned to the upstream side of the pair of transport rollers 11 as the leading edge when the recording is performed on the first surface by the reverse feed operation of the pair of transport rollers 11 and the pair of discharge rollers 17. Furthermore, the paper is fed from a portion indicated by the arrow A to a reversing path 21 by the reverse returning operation of the pair of transport rollers 11, passes through the reversing path 21, and is returned from a portion indicated by the arrow B to the paper transport path.

The paper of which front and rear surfaces are reversed and returned to the paper transport path is fed again to the lower side of the recording head 8 by the pair of transport rollers 11 and recording on a second surface serving as a side opposite to the first surface is performed. The paper on which the recording on the second surface is performed by the recording head 8 is discharged from the paper discharge unit 19 by the pair of discharge rollers 17. On the front surface side (+Y direction side) of the apparatus of the paper discharge unit 19, a medium tray 26 for receiving the discharged paper is provided.

About Path Forming Member

Figure 3:
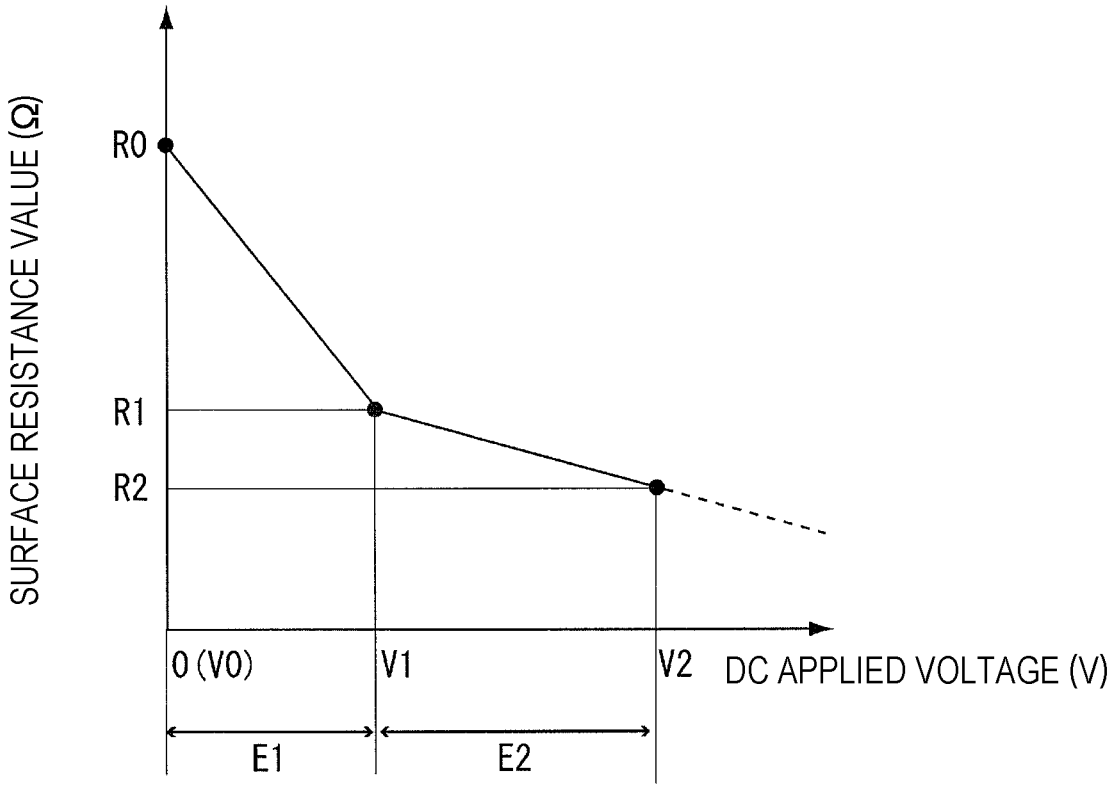
FIG. 3 is a graph showing a relationship between an applied voltage and a surface resistance value in a path forming member.

In the disclosure, the platen 14 (path forming member) shows a surface resistance value as shown in FIG. 3 according to an applied voltage. FIG. 3 shows a relationship between the DC applied voltage (V) and the surface resistance value (Ω) applied to the path forming member.

That is, the platen 14 shows a property that the surface resistance value R1 in a case where the first voltage V1 is applied is higher than the surface resistance value R2 in a case where the second voltage V2 higher than the first voltage V1 is applied. This property may be referred to as a first property in the following.

In addition, in another description, the platen 14 shows a property that the surface resistance value R0 in a case where the voltage is not applied, that is, in a case where the applied voltage is zero (V0) is higher than the surface resistance value R1 of the first voltage V1 as an example in a case where a voltage is applied. In addition, similarly, the surface resistance value R0 is higher than the surface resistance value R2 of the second voltage V2. This property may be referred to as a second property in the following.

Here, as an example, the case where the second voltage V2 higher than the first voltage V1 is applied can correspond to the case where the charged paper is in sliding contact with the platen 14, that is, the case where the paper is passing over the platen 14. In addition, the case where the first voltage V1 lower than the second voltage V2 is applied can correspond to the case where the paper does not come into sliding contact with the platen 14, that is, after the paper has passed over the platen 14.

The surface resistance value R2 in the case of applying the second voltage V2 corresponds to the surface resistance value in a state where the charged paper is in sliding contact with the path forming member. The surface resistance value R1 in the case of applying the first voltage V1 corresponds to the surface resistance value in a state where the paper has passed through and does not come into contact with the platen 14.

Incidentally, the case where the first voltage V1 or the second voltage V2 is applied may correspond to the case where the charged paper is in sliding contact with the platen 14. The case where the voltage is not applied, that is, the case where the applied voltage is zero (V0), may correspond to a state where the paper does not come into contact with the platen 14 after passing through the paper.

Based on the above, if another property of the platen 14 is further described, the platen 14 shows a property that the surface resistance value in a state where the charged paper passes through and does not come into contact with the platen is higher than the surface resistance value in the state where the charged paper is passing while being in contact. This property may be referred to as a third property in the following.

Incidentally, in the specification, the fact that the platen 14 as the "path forming member" shows the first to third and the fourth properties described later means not only the case where the platen 14 has the property as its own physical property, but also the case where the property is imparted to the platen 14 under the action from others.

The smaller the surface resistance value of the platen 14 is, the more rapidly the charge elimination of the charged paper can be performed.

Therefore, in a case where a paper with a large charge amount is in sliding contact with the platen 14 by the platen 14 showing the first property, the second property, and the third property, for example, with a small surface resistance value R2 in a case where the second voltage V2 higher than the first voltage V1 is applied, the charge elimination of the paper can be performed rapidly.

Incidentally, after the paper has passed over the platen 14, the paper dust dropped from the paper may remain in the vicinity of the platen 14. Paper dust dropped from the paper before charge elimination is charged.

For example, if a platen made of a conductive metal such as copper or aluminum is used, the surface resistance value of the platen does not change while maintaining a small value even if the charged paper passes through (corresponding to a state where applied voltage is high) or after passing through the medium (corresponding to a state where applied voltage is low). Therefore, the charged paper dust is rapidly charge-eliminated by a metal platen having a low surface resistance value. However, the discharged paper dust is likely to float, and the floating paper dust adheres to the recording head 8. Therefore, there is a possibility that problems such as dot blank in the recorded image may occur.

On the other hand, in the platen 14 according to the embodiment, the surface resistance value in a case where the first voltage V1 is applied (corresponding to the state after the paper has passed over the platen 14) is higher than the surface resistance value in a case where the second voltage V2 higher than the first voltage V1 is applied (corresponding to a state where the paper is passing over the platen 14). That is, after the paper has passed over the platen 14, the charge elimination capability becomes weaker than when passing the paper.

Therefore, the paper dust remaining in a vicinity of the platen 14 is hardly charge-eliminated, and it is easy to maintain a charged state of low-voltage for a while. The low-voltage charged paper powder can be adsorbed by attracting to the platen 14 by electrostatic attraction. As a result, it is difficult for paper dust to adhere to the head surface of the recording head 8, and it is possible to suppress problems of dot blank in the recorded image.

As described above, by the platen 14 showing the first to third properties, both the quick charge elimination of the charged paper and the suppression of problems derived from the paper dust remaining in the vicinity of the platen 14 after passing the paper can be realized, and the paper can be more suitably charge-eliminated.

In addition, in the embodiment, the platen 14 further shows a property that a rate of change of the surface resistance value which increases in a case where the applied voltage is changed from the first voltage V1 to zero (V0) is higher than a rate of change of the surface resistance value which increases in a case where the applied voltage is changed from the second voltage V2 higher than the first voltage V1 to the first voltage V1 (hereinafter may be referred to as fourth property).

That is, as shown in FIG. 3, an absolute value of a slope representing the change in the surface resistance value in a case where the applied voltage is changed from the first voltage V1 to zero (V0) is higher than an absolute value of a slope representing the change in the surface resistance value in a case where the applied voltage is changed from the second voltage V2 higher than the first voltage V1 to the first voltage V1.

Incidentally, changes in the surface resistance value when the applied voltage is changed are not always linear, and are shown as straight lines in FIG. 3 for the sake of clarity.

since the platen 14 shows the fourth property, in a case where the paper is not present on the platen 14 (corresponding to region E1 where applied voltage is low in FIG. 3), the paper has a weak charge elimination capability, and in a case where the charged paper passes over the platen (corresponding to region E2 where applied voltage is high in FIG. 3), the paper can quickly and stably charge-eliminate.

As an example, the platen 14 showing the first to fourth properties can be realized by forming the platen 14 from a resin material containing carbon nanotubes (hereinafter sometimes referred to as CNT) in the range of 2 wt % or more and less than 6 wt %.

As the resin material, plastic resins such as polyethylene, polypropylene, ethylene-propylene copolymer, styrene-butadiene copolymer and the like can be used.

Incidentally, the resin material may contain various additives (such as a stabilizer such as an antioxidant and function imparting agent such as a plasticizer) in addition to the main component polymer.

As carbon nanotubes, multi-walled carbon nanotubes can be used. In addition, two-layer or single-layer carbon nanotubes can also be used.

Figure 4:
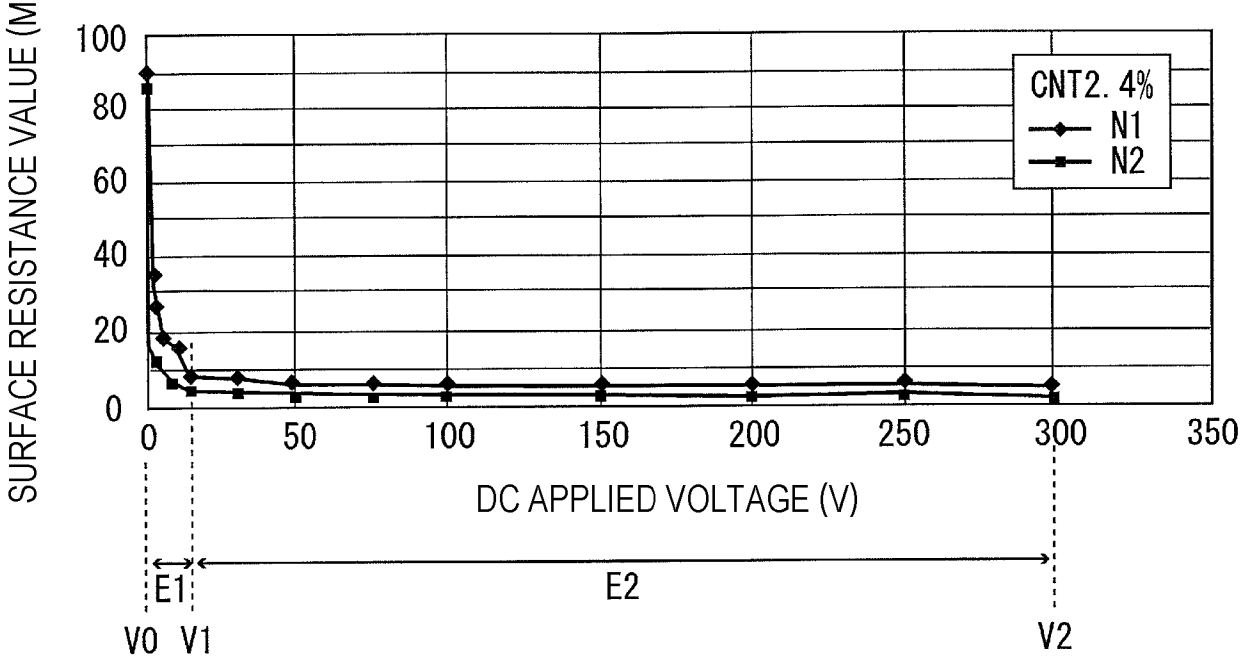
FIG. 4 is a graph showing a relationship between applied voltage and surface resistance value in a path forming member having a CNT content of 2.4 wt %.
Figure 5:
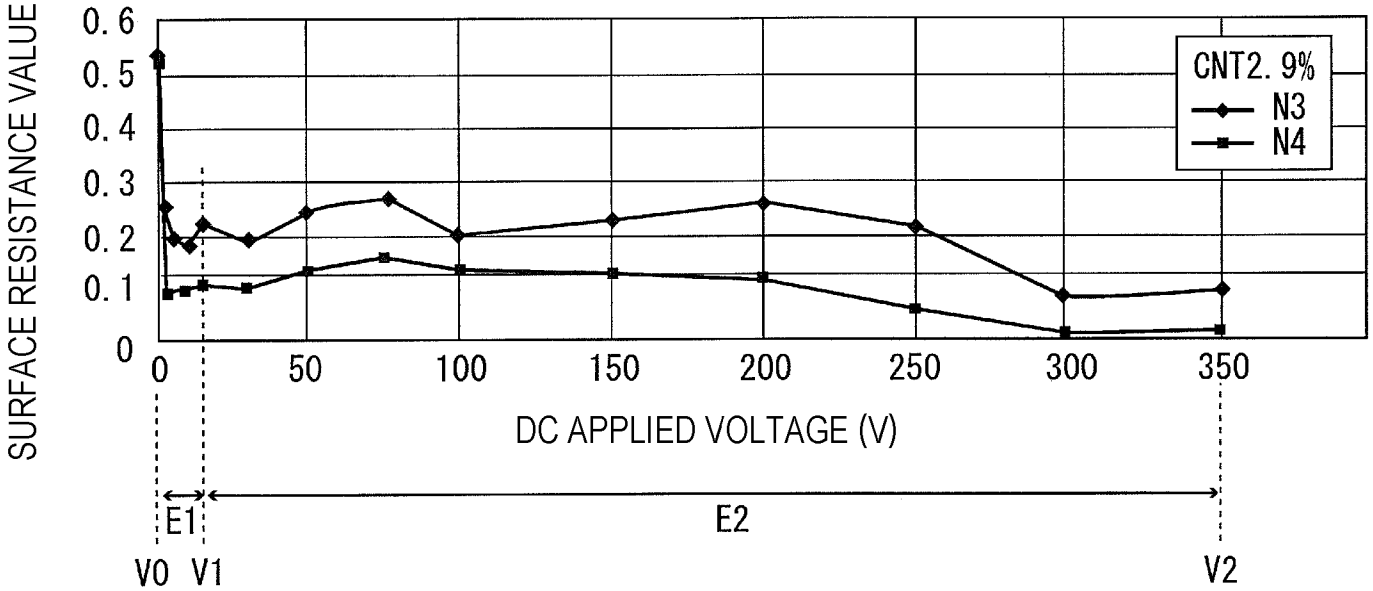
FIG. 5 is a graph showing a relationship between applied voltage and surface resistance value in a path forming member having a CNT content of 2.9 wt %.
Figure 6:
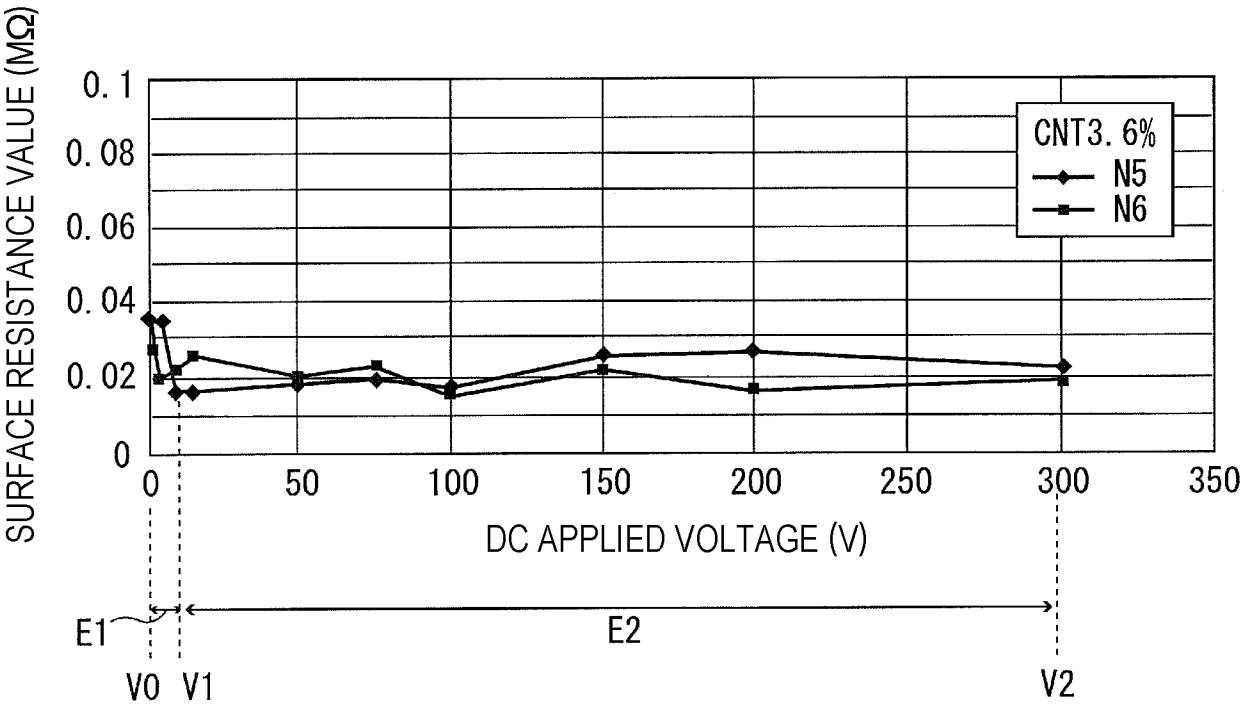
FIG. 6 is a graph showing a relationship between applied voltage and surface resistance value in a path forming member having a CNT content of 3.6 wt %.

FIGS. 4 to 6 are graphs showing the relationship between the applied voltage and the surface resistance value in platens (N1 to N6) containing multi-layer carbon nanotubes and formed of a resin material containing a styrene-butadiene copolymer as a main component. FIG. 4 is a graph in a case where the carbon nanotube content is 2.4 wt %, and FIG. 5 is a graph in a case where the carbon nanotube content is 2.9 wt %. FIG. 6 is a graph in a case where the carbon nanotube content is 3.6 wt %. In each drawings, data of two platens with the same CNT content are cited (platen N1, N2 having a CNT content of 2.4 wt % in FIG. 4, platen N3, N4 having a CNT content of 2.9 wt % in FIG. 5, platen N5, N6 having a CNT content of 3.6 wt % in FIG. 6).

Platens N1 to N6 prepared using a styrene-butadiene copolymer containing carbon nanotubes containing 2.4 wt % (FIG. 4), 2.9 wt % (FIG. 5), or 3.6 wt % satisfy the first to fourth properties.

Incidentally, for the multi-layer carbon nanotube contained in the resin material forming the platens N1 to N6, NC7000 series, thin multi-wall carbon nanotubes manufactured by NANOCYL Co., Ltd. (tube average diameter 9.5 nm, average tube length 1.5 μm, specific surface area 250-300 $m^2/g$) was used.

Subsequently, data obtained by measuring the paper charge amount (V) in a case where 20 sheets of paper were passed on the platen 14 formed by changing the carbon nanotube content (hereinafter referred to as CNT content) is shown in Table 1.

Figure 7:
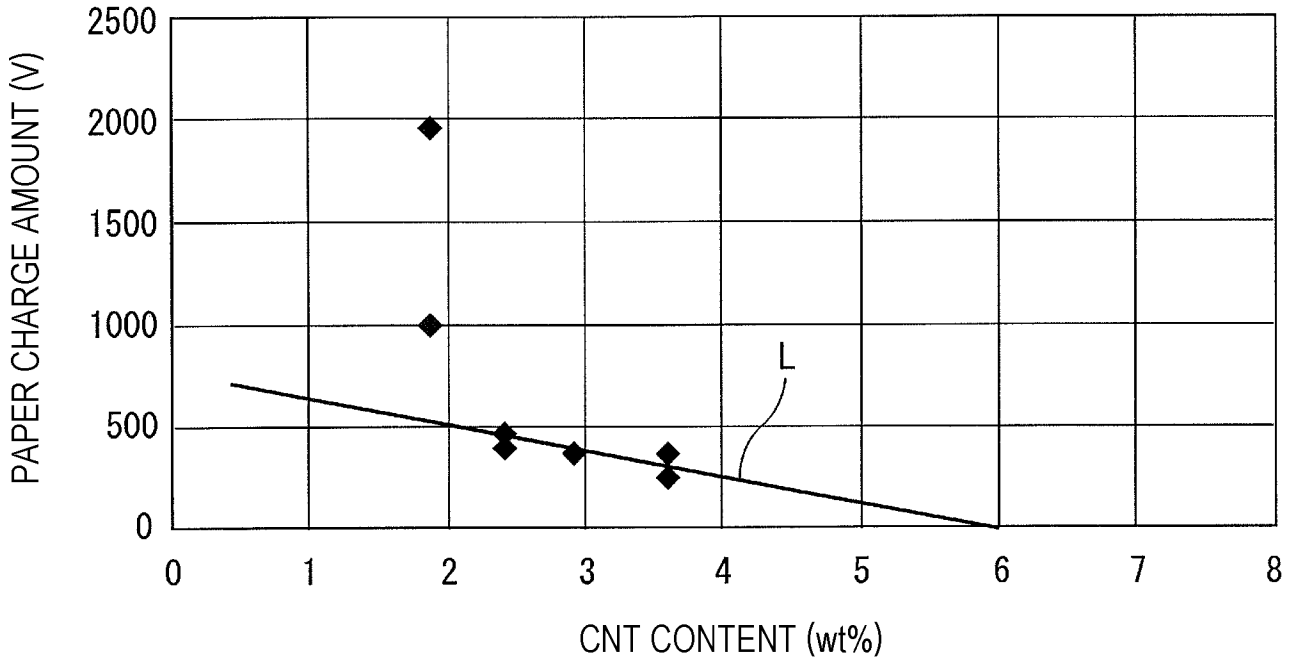
FIG. 7 is a graph showing a relationship between the CNT content and a paper charge amount after 20 sheets are fed.

In addition, FIG. 7 shows a graph where the results in Table 1 are plotted with the paper charge amount (V) on the vertical axis and the CNT content on the horizontal axis.

TABLE 1

| CNT content (wt %) | Paper charge amount (V) |
|---|---|
| 1.9 | 1940 |
| 1.9 | 1000 |
| 2.4 | 462 |
| 2.4 | 465 |
| 2.4 | 465 |
| 2.9 | 374 |
| 3.6 | 363 |
| 3.6 | 244 |

As shown in Table 1, in a case where the CNT content is 1.9 wt % smaller than 2.0 wt %, the paper charge amount exceeds 1000 V, and sufficient charge elimination of the paper is not performed.

On the other hand, at the CNT content of 2.4 wt %, 2.9 wt %, and 3.6 wt %, it can be said that the paper charge amount is 500 V or less, and favorable charge elimination of the paper is performed.

In addition, it can be found that when the CNT content are 2.4 wt %, 2.9 wt %, and 3.6 wt %, linearity tends to be established in the relationship between the CNT content and the paper charge amount after 20 sheets are passed (straight line indicated by reference numeral L in FIG. 7).

In FIG. 7, the CNT content at which the straight line L intersects with the horizontal axis (CNT content), that is, the paper charge amount becomes zero is 6.0 wt %. The result that the paper charge amount after passing through 20 sheets is zero is substantially the same as that of the platen formed of the conductive metal material. Therefore, it is considered that resin materials containing 6.0 wt % or more of carbon nanotubes cannot sufficiently obtain the first to fourth properties.

From these facts, by forming the platen 14 with a resin material containing carbon nanotubes in the range of 2 wt % or more and less than 6 wt %, it is possible to more surely have the structure showing the first to fourth properties.

In addition, the platen 14 formed of a resin material containing carbon nanotubes in the range of 2 wt % or more and less than 6 wt % can significantly reduce the frequency of dot blank in the recorded image.

Table 2 is a table showing the relationship between the CNT content and the frequency at which dot blank occurs (hereinafter referred to as dot blank frequency). The dot blank frequency is the number of recorded sheets until one dot blank occurs. The dot blank is often caused by paper dust adhering to the head surface of the recording head 8. It can be said that paper dust is unlikely to adhere to the head surface of the recording head 8 because the floating of the paper dust is suppressed as the number of dot blank frequencies is increased.

TABLE 2

| CNT content (wt %) | Dot blank frequency (number of sheets) |
|---|---|
| 0.0 | 200 |
| 1.9 | 400 |
| 2.4 | 1500 |

As shown in Table 2, in the platen 14 formed of a resin material containing 2.4 wt % of CNT, the number of sheets that can be recorded until one dot blank occurs is significantly improved.

As described above, the platen 14 formed of the resin material containing the carbon nanotubes in the range of 2 wt % or more and less than 6 wt % can realize both rapid charge elimination of the charged paper and suppression of problems derived from paper dust remaining in the vicinity of the platen 14 after passing through the paper, so that the paper can be more suitably charge-eliminated.

About Other Configuration in Printer

Figure 8:
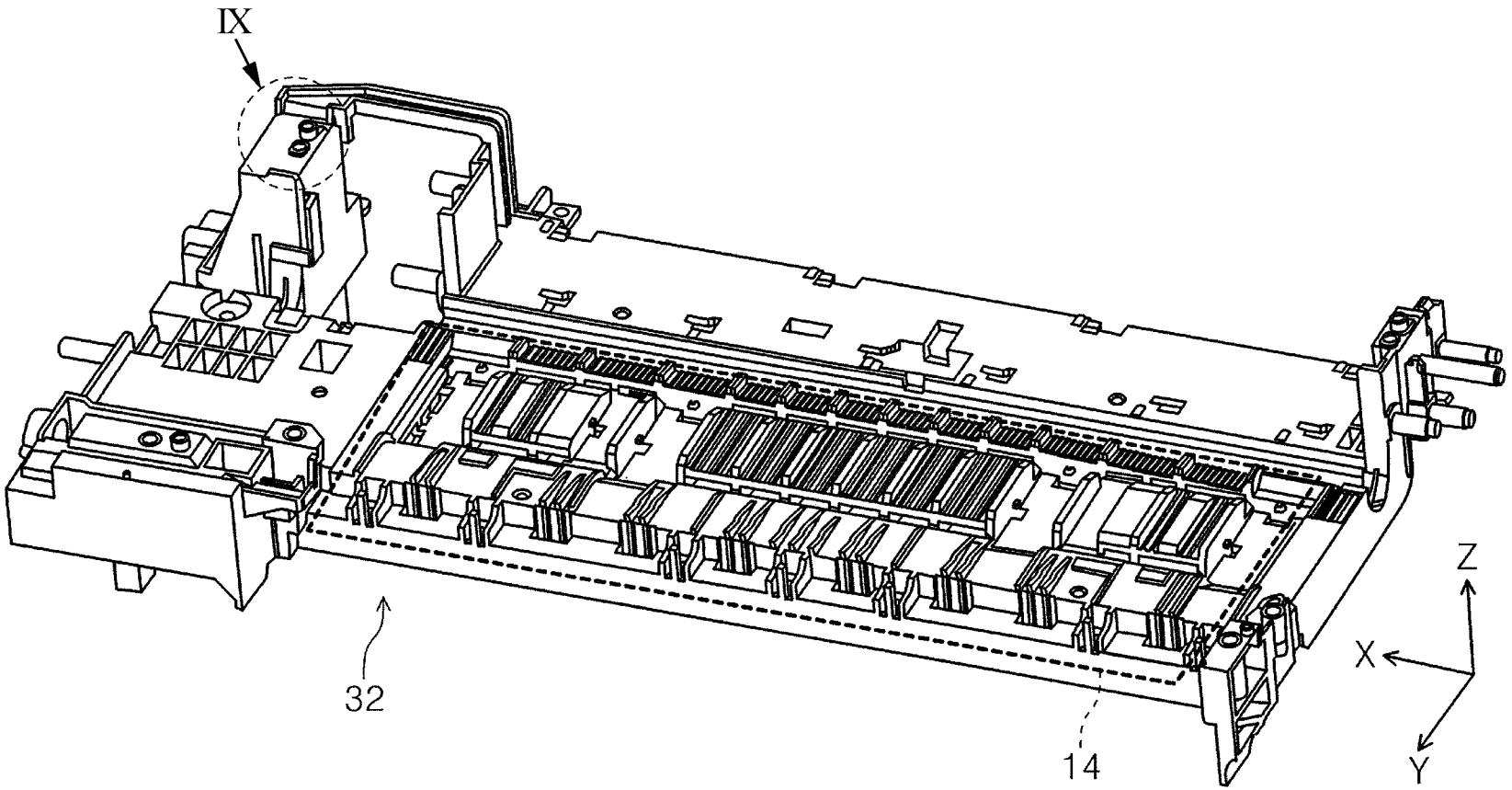
FIG. 8 is an external perspective view of a support unit including a platen.

As shown in FIG. 8, the platen 14 is formed as a support unit 32 including a portion of the platen 14. In the embodiment, the support unit 32 is formed of a resin material containing carbon nanotubes.

Figure 9:
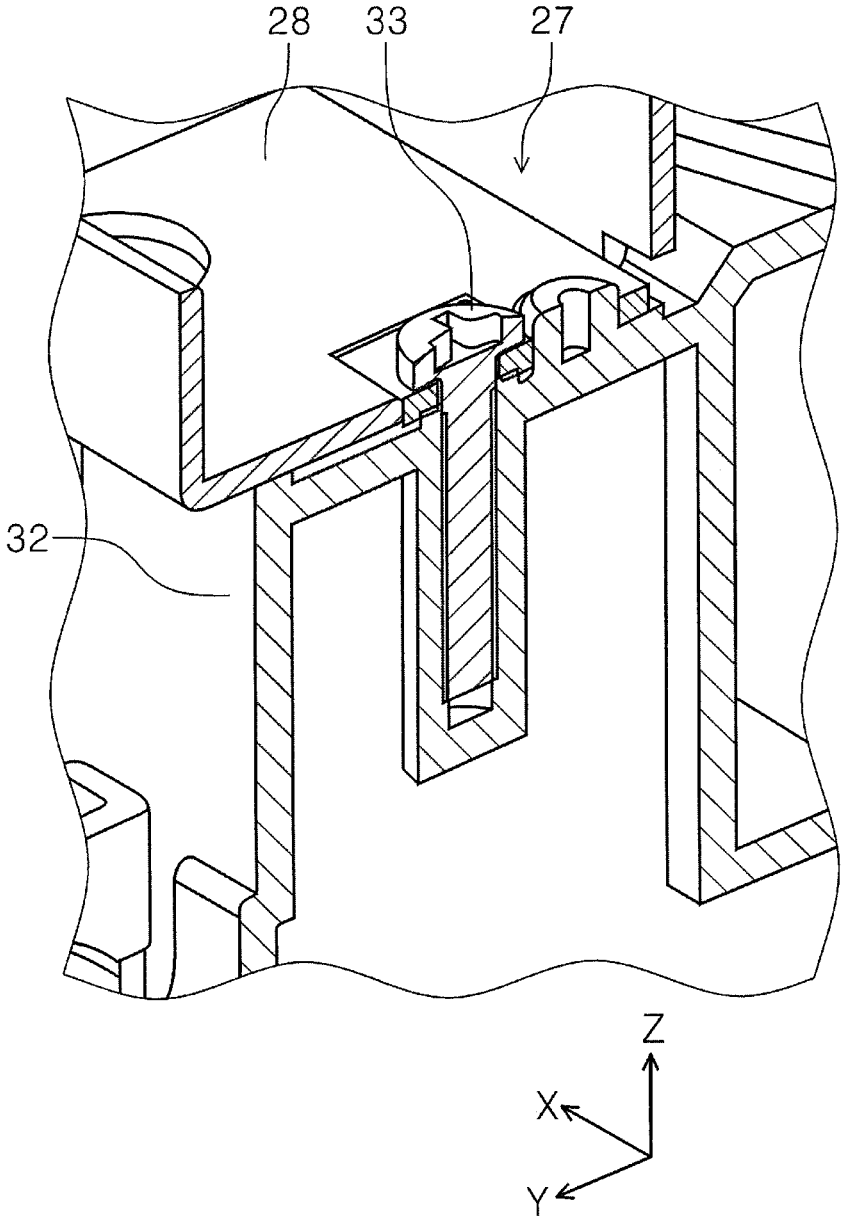
FIG. 9 is an enlarged cross-sectional view of a portion IX shown in FIG. 2.

The support unit 32 is connected to a component having electrical conductivity inside the apparatus main body, and is grounded to the ground via the component having conductivity. In the embodiment, the component having conductivity is the main frame 27 formed of a conductive metal material. In the portion IX shown in FIG. 2, the support unit 32 is connected to a portion of the guide rail 28 of the main frame 27. More specifically, as shown in FIG. 9, the support unit 32 is connected to the guide rail 28 via a screw 33 formed of a conductive metal material. Incidentally, the portion IX in FIG. 2 corresponds to a portion IX in FIG. 8.

Modification Example 1 of Platen

Figure 11:
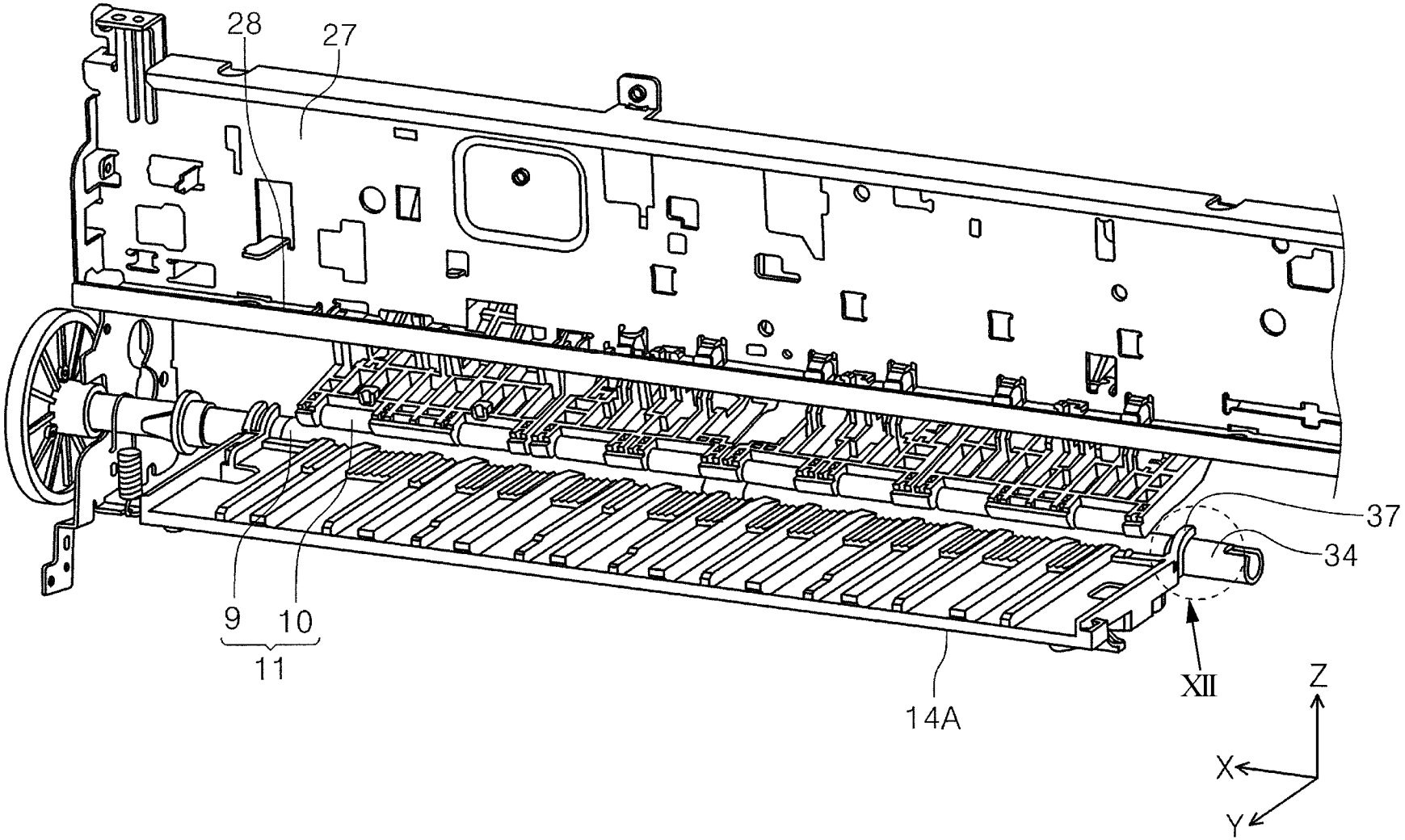
FIG. 11 is a view showing another example of a platen.

The above-described platen 14 can be formed as a portion of the support unit 32 shown in FIG. 8, or can be a platen 14A formed as a single "support member" for supporting the paper, as shown in FIG. 11. Similarly to the platen 14, the platen 14A is formed of a resin material containing carbon nanotubes. The platen 14A is grounded via a driving shaft 34 of the transport driving roller 9. The driving shaft 34 is made of a material having conductivity.

Figure 12:
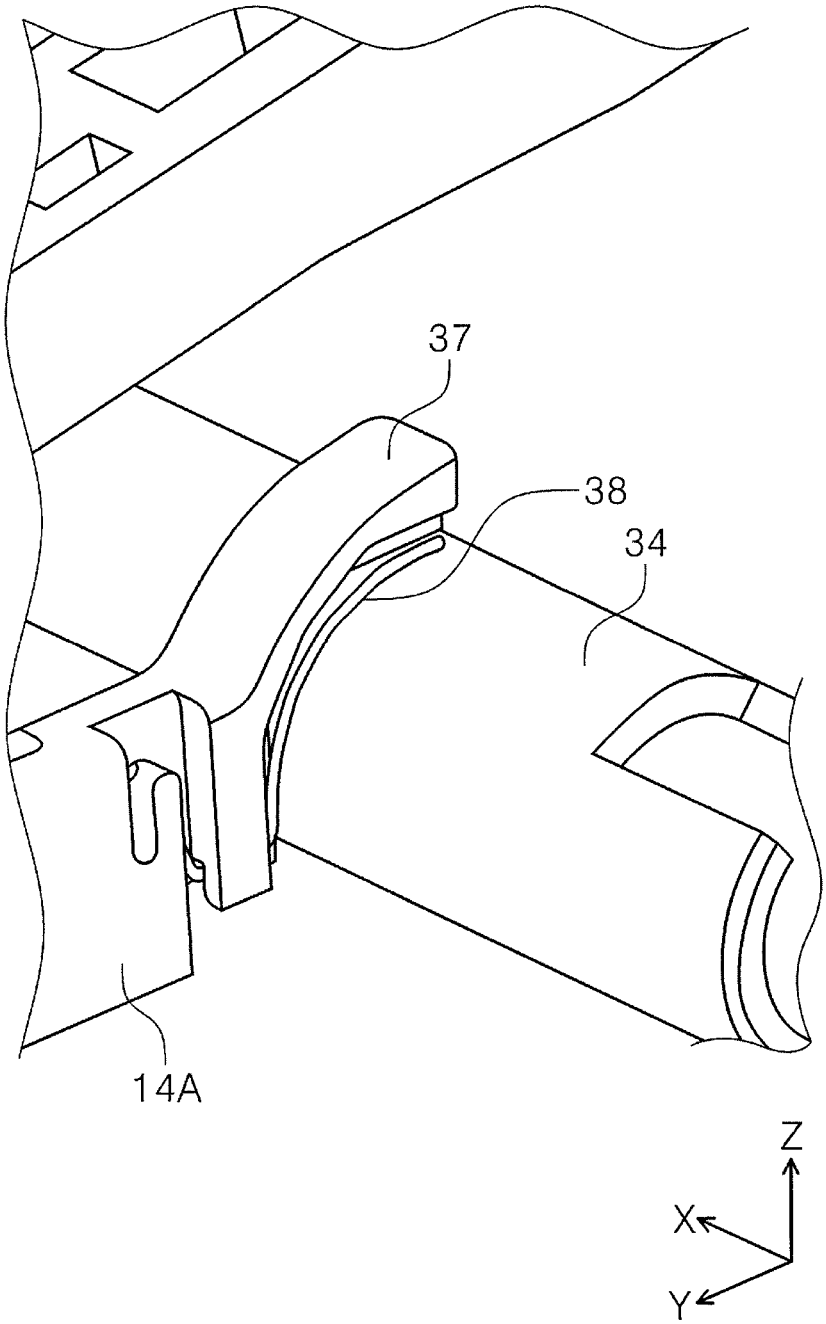
FIG. 12 is an enlarged view of a portion XII shown in FIG. 11.

The platen 14A is connected to the driving shaft 34 in the portion XII in FIG. 11. The platen 14A is provided with an attaching portion 37 to the driving shaft 34. Between the attaching portion 37 and the driving shaft 34, as shown in FIG. 12 which is an enlarged view of the portion XII in FIG. 11, the pressing member 38 for pressing the attaching portion 37 against the driving shaft 34 is provided. For the pressing member 38 shown in FIG. 12, a rod spring formed of a material having conductivity is used.

Figure 10:
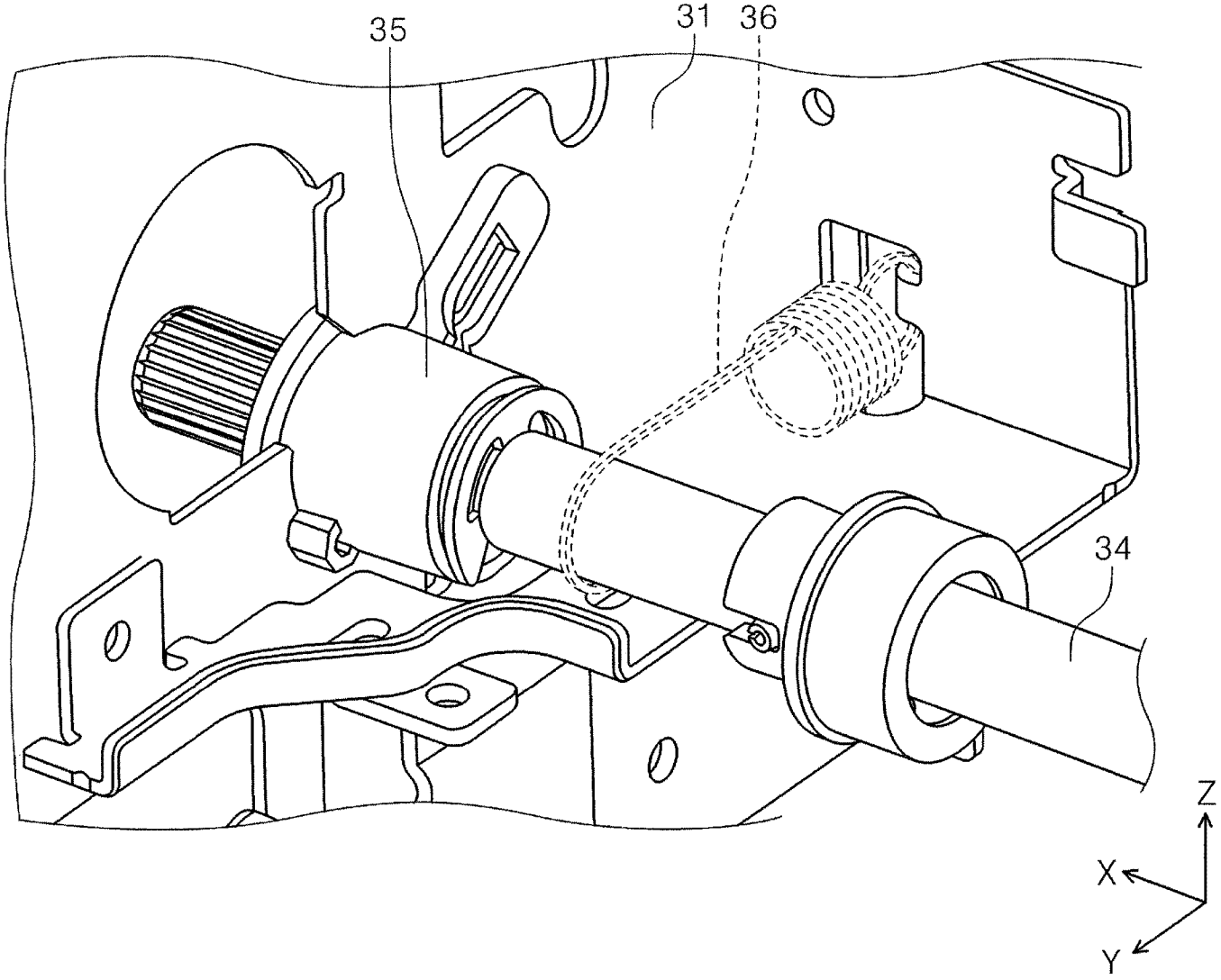
FIG. 10 is a view showing a configuration in which a driving shaft of a transport driving roller is attached to a side frame.

As shown in FIG. 10, the driving shaft 34 is attached to a bearing portion 35 provided in the side frame 31 and may be grounded from the side frame 31. The side frame 31 and the driving shaft 34 are made of a metal material having conductivity. Examples of the metal material having conductivity include copper, aluminum, alloys containing these, and the like.

The side frame 31 is provided with the bearing portion 35 into which the driving shaft 34 is inserted. At this time, in a case where the bearing portion 35 is formed of a material not having conductivity, it is necessary to connect the side frame 31 and the driving shaft 34 by a connection member 36 having conductivity (indicated by a dotted line in FIG. 10).

Here, by forming the bearing portion 35 with a resin material containing carbon nanotubes similar to the above-described platen 14, it is possible to ground without the connection member 36, so that the number of parts can be reduced.

In addition, the platen 14A formed as a single "support member" for supporting the paper may be grounded as follows.

Figure 13:
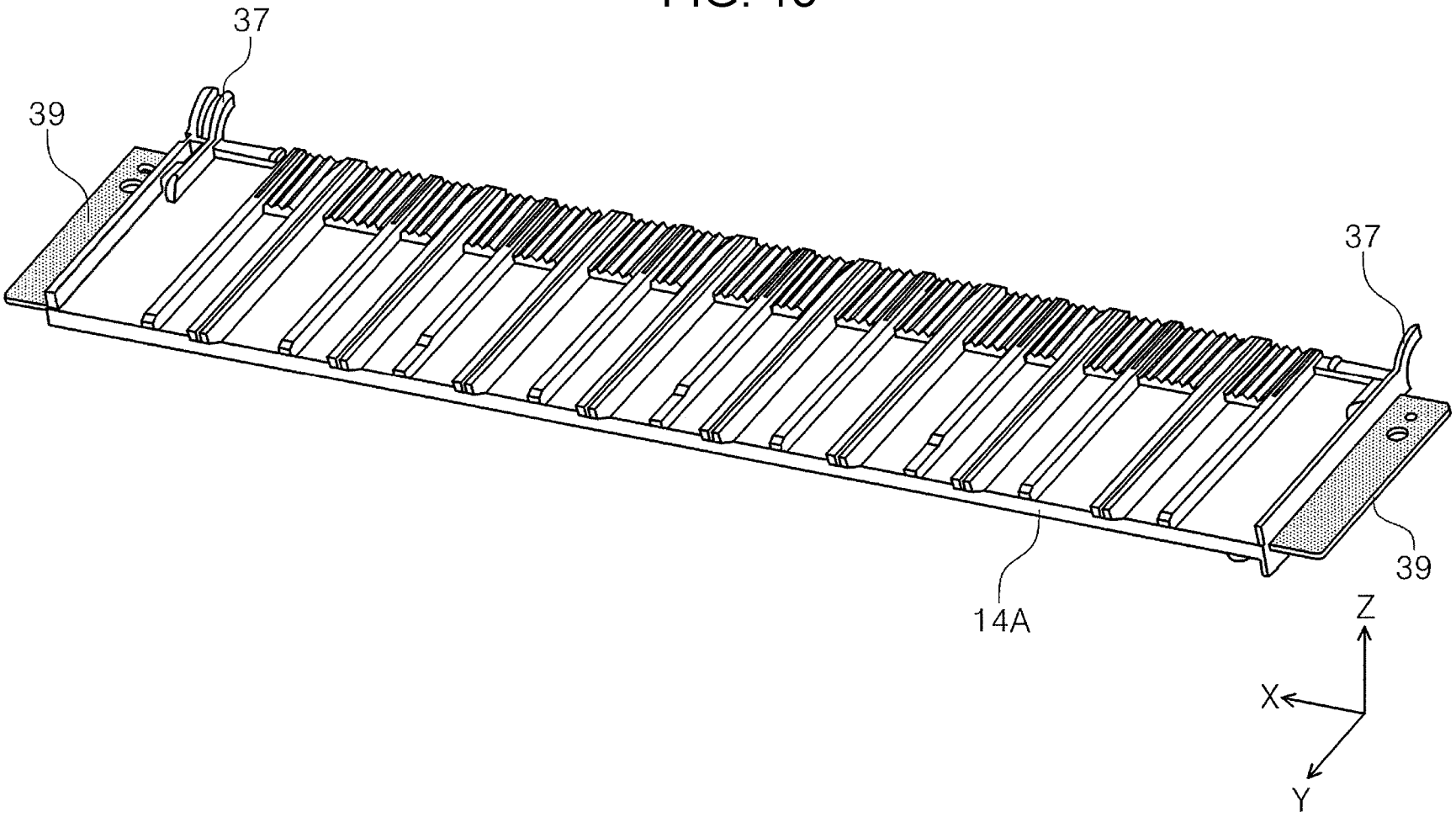
FIG. 13 is a view showing still another example of a platen.

That is, as shown in FIG. 13, plates 39 and 39 made of a metal material having conductivity are inserted into both sides in the width direction of the platen 14A, and the plates 39 and 39 are screwed to the metal frame such as the main frame 27 and the side frame 31 shown in FIG. 2. As shown in FIG. 10, the main frame 27 and the side frame 31 are connected to the driving shaft 34 having conductivity, and are grounded to the ground.

Second Embodiment

In the first embodiment, the configuration in which the platen 14 itself has the first to fourth properties, and the platen 14 shows the first to fourth properties is described.

In the second embodiment, the platen as the "path forming member" is originally formed of a material having no first to fourth properties, and a configuration for showing the first to fourth properties by receiving action from the other will be described with reference to FIG. 14.

Figure 14:
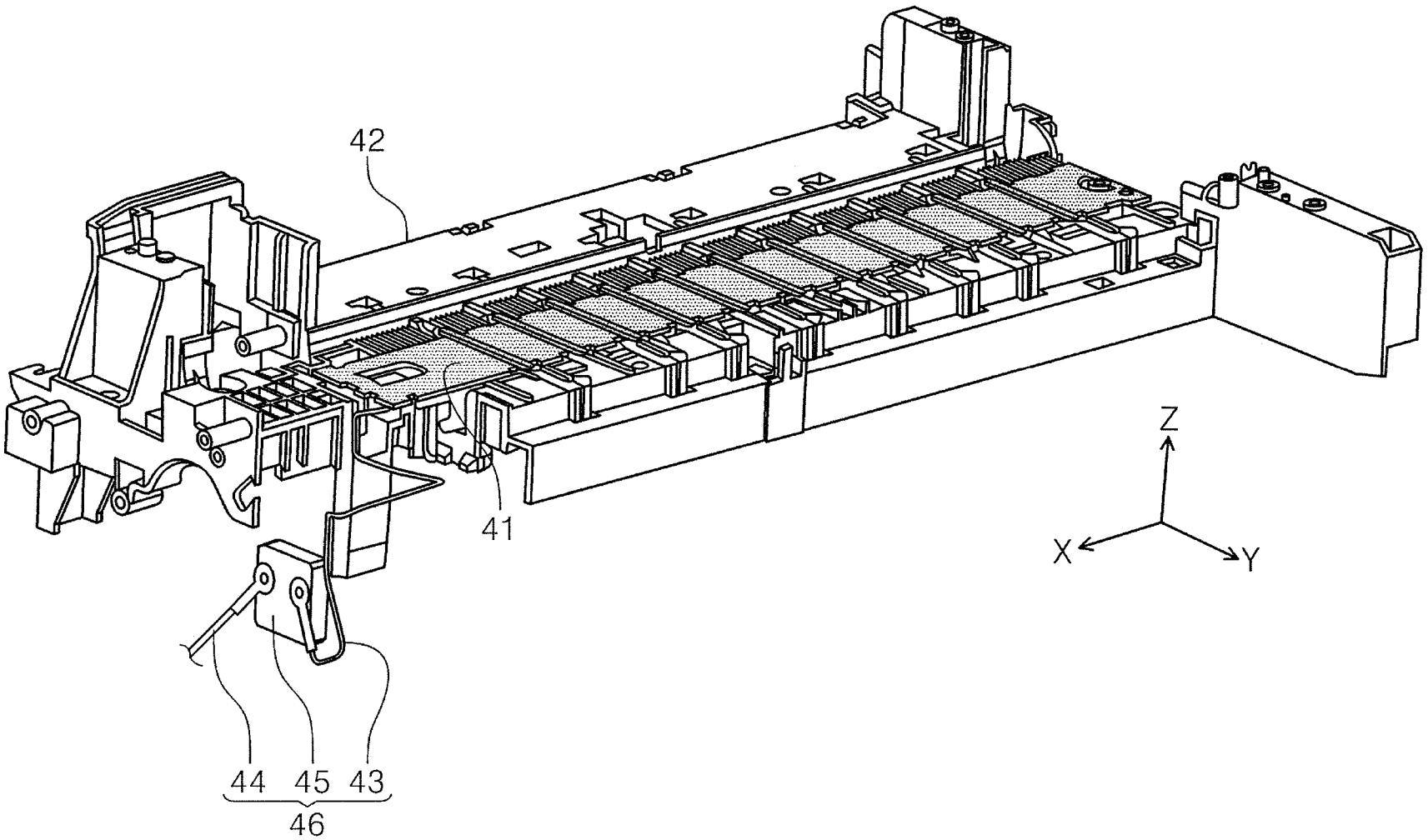
FIG. 14 is a view describing a second embodiment.

In the second embodiment, a platen 41 (path forming member) shown in FIG. 14 is made of a metal material having conductivity. The platen 41 is attached to, for example, a base portion 42 to which the main frame 27 and the side frame 31 (not shown in FIG. 14) are attached. Incidentally, the base portion 42 is formed of a resin material not containing CNT.

Here, the metal platen 41 does not have the first to fourth properties as it is. That is, if the platen 41 is grounded to the ground as it is by a ground member such as an earth wire, the surface resistance value of the platen 41 does not change while maintaining a small value even in a state where the charged paper passes through, that is, in the high voltage state and the low voltage state after passing the paper.

In the embodiment, a ground member 46 that grounds the platen 41 to the ground includes a relay member 45 having the same first to fourth properties as the platen 14 described in the first embodiment. As a result, the platen 41 made of a metal material can show the first to fourth properties.

The ground member 46 has an earth wire 43 connected to the platen 41 and an earth wire 44 grounded to the ground, and is formed by connecting the earth wire 43 and the earth wire 44 via the relay member 45.

The relay member 45 has such a property (first property) that the surface resistance value R1 in a case where the first voltage V1 is applied is higher than the surface resistance value R2 in a case where the second voltage V2 higher than the first voltage V1 is applied.

In addition, if the properties of the relay member 45 are described differently, the relay member 45 has such a property (second property) that the surface resistance value R0 in a case where the voltage is not applied is higher than the surface resistance value in a case where a voltage is applied.

If the properties of the relay member 45 are further described differently, the surface resistance value of the relay member 45 in a state where the charged paper passes through and does not come into contact with the platen 41 is higher than the surface resistance value of the relay member 45 in a state where the charged paper is passing while being in contact with the platen 41 (third property).

If the properties of the relay member 45 are further described differently, a rate of change of the surface resistance value which increases in a case where the applied voltage is changed from the first voltage V1 to zero (V0) is higher than a rate of change of the surface resistance value which increases in a case where the applied voltage is changed from the second voltage V2 higher than the first voltage V1 to the first voltage V1 (fourth property).

The platen 41 is grounded to the ground via the relay member 45 having the first to fourth properties as described above. Therefore, the platen 41 made of a metal material shows first to fourth properties, and thus, similarly to the first embodiment, the paper passing over the platen 41 can be more suitably charge-eliminated.

As a configuration for imparting the first to fourth properties to the platen 14 by other actions, for example, it can also be realized by forming the platen 14 with a conductive metal material and providing a variable resistance circuit connected to the platen 14 to change the surface resistance value of the platen 14.

Third Embodiment

In the first embodiment and the second embodiment, although the platens 14, 14A, and 41 as the "support member" for supporting the paper at the position facing the recording head 8 are the "path forming members", it is also possible to make another part of the transport path S a "path forming member" showing the first to fourth properties.

For example, the "path forming member" may be configured to form at least a portion of the transport path S from the hopper 4 as a "medium placement unit" in FIG. 1 and the paper support 5 to the recording head 8 as the "processing unit".

Figure 15:
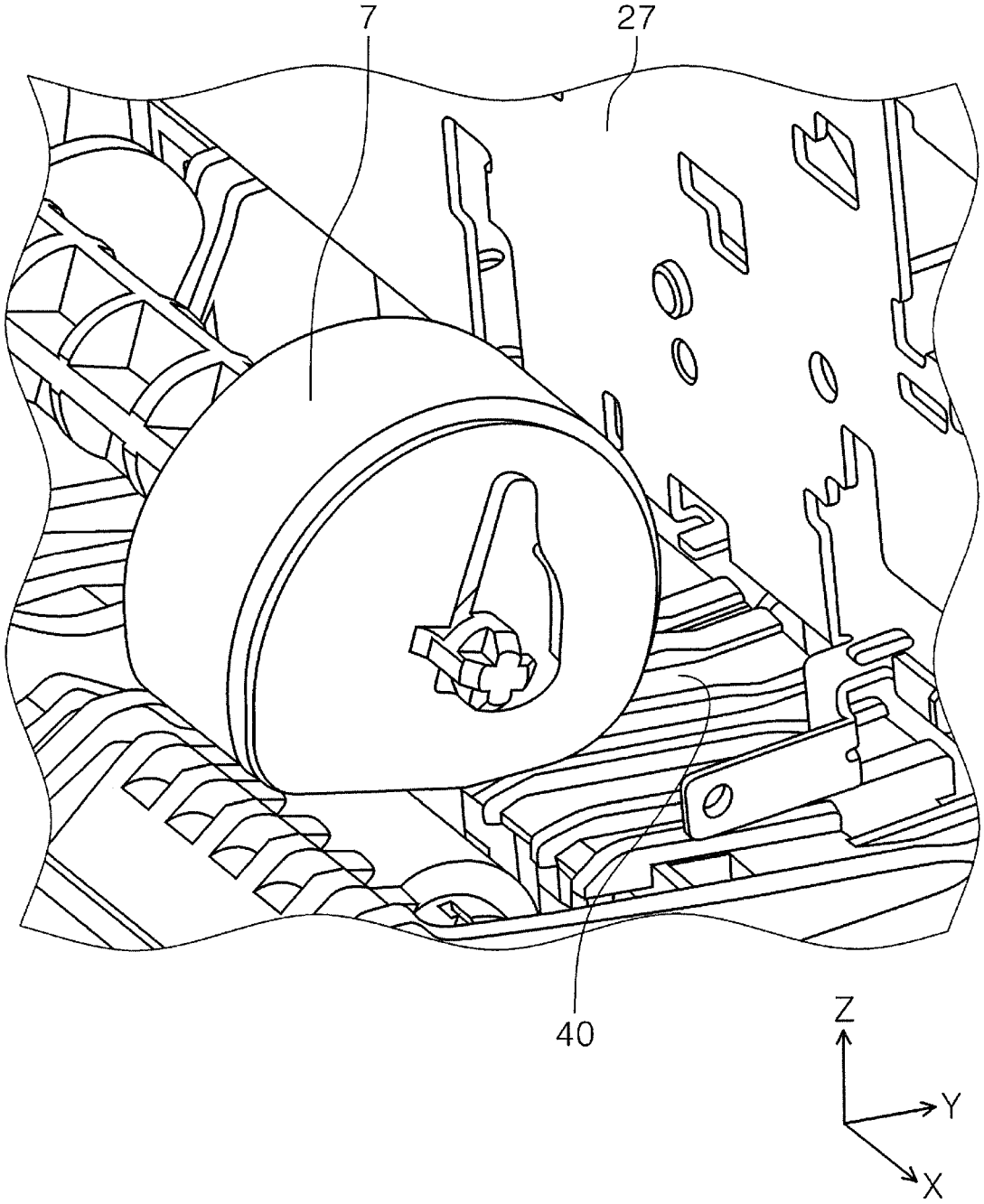
FIG. 15 is an enlarged perspective view in a vicinity of a feeding roller.

In the embodiment, as an example, a first member 40, which is a path surface on the downstream side of the feeding roller 7 shown in FIGS. 1 and 15, is defined as a "path forming member" showing the first to fourth properties.

In order to charge-eliminate the paper fed by the feeding roller 7, there may be a case where a charge eliminating portion such as a charge eliminating cloth is provided on the downstream side of the feeding roller 7. By setting the first member 40 to be the "path forming member" showing the first to fourth properties, it is possible to charge-eliminate the sheet without providing a charge-eliminating portion, so that the number of parts can be reduced.

In addition, if the paper dust flies in the vicinity of the feeding roller 7, there is a possibility that the paper dust may adhere to the surface of the feeding roller 7. If the paper dust adheres to the surface of the feeding roller 7, there are cases where proper feeding cannot be performed, or the paper to be fed is scratched.

By making the first member 40 the "path forming member" showing the first to fourth properties, in addition to the charge elimination of the paper, the paper dust remaining after passage of the paper can be adsorbed by the first member 40, and adhesion of paper dust to the surface of the feeding roller 7 can be suppressed. Therefore, it is possible to reduce problems caused by the paper dust adhering to the surface of the feeding roller 7.

In addition, in FIG. 1, a roller holder 47 that holds the discharge driven roller 16 and forms a path surface on the upper side of the transport path S may be a "path forming member" showing the first to fourth properties.

The roller holder 47 may extend in the −Y direction in FIG. 1 and may also hold the regulating roller 18.

Fourth Embodiment

The "path forming member" showing the first to fourth properties can also be provided in a paper transport path in an apparatus other than the recording apparatus (printer).

For example, in an image reading apparatus for reading a paper as a "medium" being transported, a portion of the transport path can be formed of "path forming member" showing the first to fourth properties.

Figure 16:
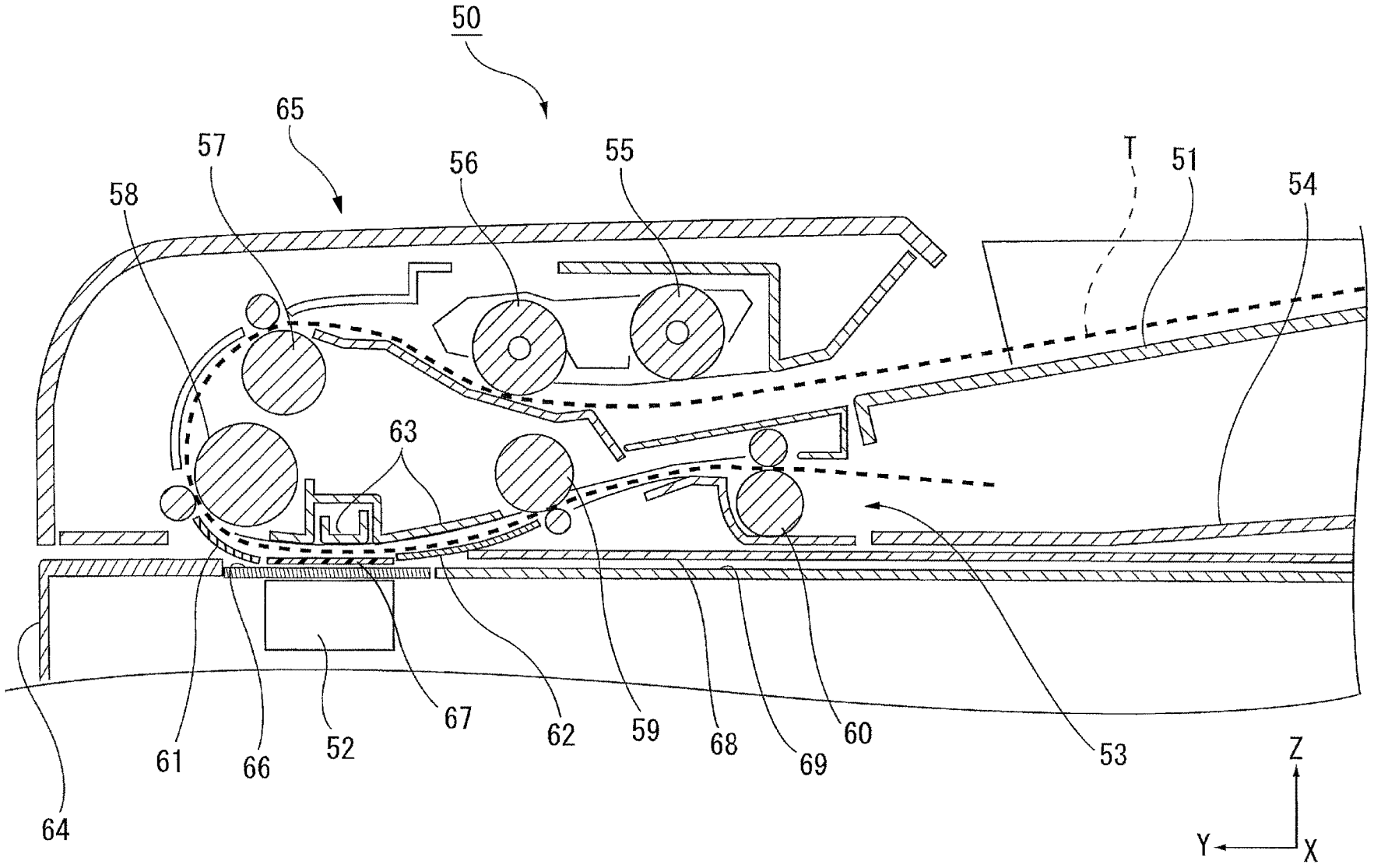
FIG. 16 is a schematic cross-sectional view of a main part showing an example of a scanner according to the disclosure.

A scanner 50 as an example of the image reading apparatus shown in FIG. 16 is provided with a flat head type scanner unit 64 for reading a paper placed on a document table 69, and a medium transport device 65 for automatically transporting the paper placed on a medium placement unit 51 toward a reading unit 52.

The scanner unit 64 is provided with the reading unit 52 that reads an image on a paper. The reading unit 52 is, for example, an optical reading unit such as a CIS system or a CCD system. The reading unit 52 is configured to be movable in the Y axis direction, and reads the paper placed on the document table 69. The document table 69 is made of colorless transparent glass. A pressing plate 68 for pressing the paper placed on the document table 69 is provided in the lower portion of the medium transport device 65.

In FIG. 16, the reading unit 52 is located at a home position at a position away from the document table 69 in the Y axis direction. Above the home position, there is provided a window portion 66 formed of a colorless and transparent glass plate similar to the document table 69. The reading unit 52 is configured to be capable of reading the paper transported by the medium transport device 65 at the home position.

The medium transport device 65 includes a transport path T through which the paper is transported. The scanner 50 is provided with the medium placement unit 51 for placing the paper to be fed. The scanner 50 is configured to transport the paper placed on the medium placement unit 51 by curving and reversing the paper along the transport path T, and to read the image by the reading unit 52 provided on the transport path T after the reversal. Thereafter, the scanner 50 discharges the paper from a discharge portion 53 toward a medium tray 54.

In FIG. 16, reference numerals 55 to 60 denote a plurality of transport rollers as a "transport unit" for transporting the paper on the transport path T.

Incidentally, the transport path T may be a straight path that feeds the paper toward the reading unit 52 without curving and reversing the paper.

A sheet member 67 formed of a colorless transparent material such as a resin film sheet or the like is provided at a position facing the reading unit 52 and the window portion 66 on the transport path T. The sheet member 67 forms a portion of the path surface of the transport path T. The paper transported along the transport path T is read by the reading unit 52 via the colorless and transparent sheet member 67 and the window portion 66.

Incidentally, the sheet member 67 is liable to be charged if the paper being transported is charged. In addition, the electric charge charged in the sheet member 67 is unlikely to escape. If the sheet member 67 is charged, the paper dust coming out of the paper adheres to the sheet member 67, and there is a possibility that the quality of the read image deteriorates.

Figure 17:
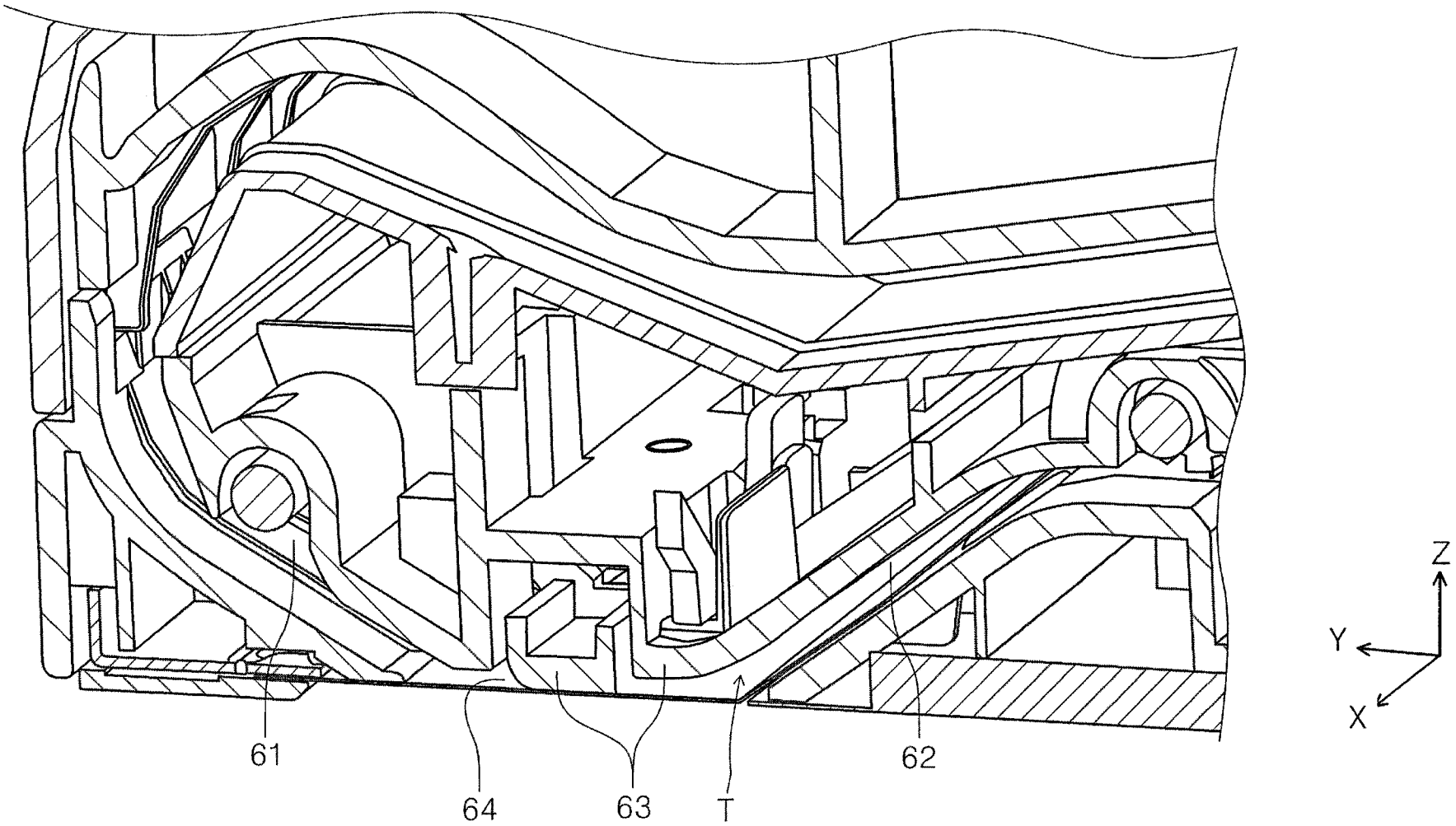
FIG. 17 is a cross-sectional perspective view of a main part of a transport path of the scanner.
Figure 18:
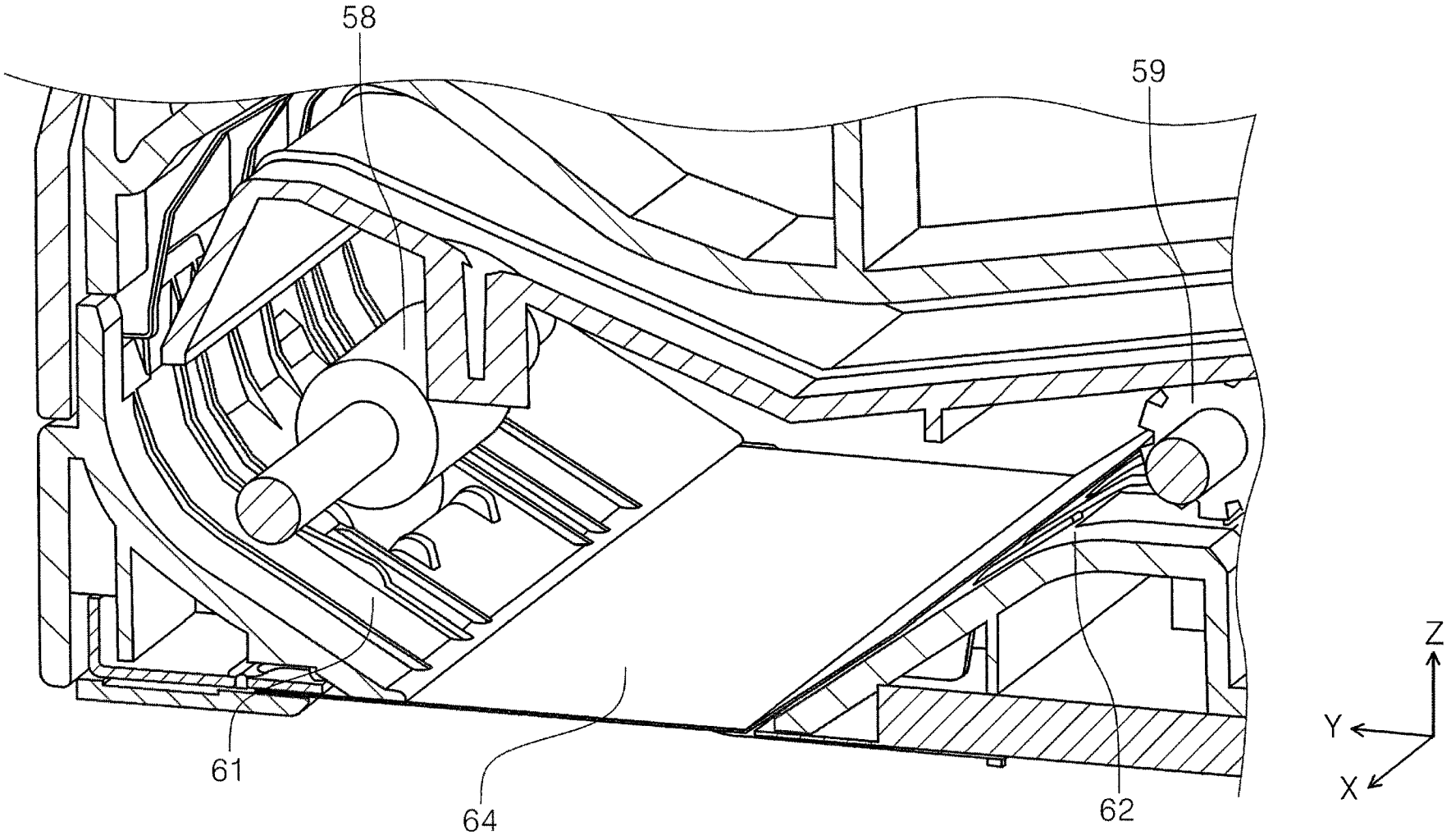
FIG. 18 is a view showing a state where an opposed member is detached from FIG. 17.

Here, by disposing the "path forming member" showing the first to fourth properties in the vicinity of the sheet member 67, the charging of the sheet member 67 can be suppressed. More specifically, at least one of an upstream side member 61 (refer to also FIGS. 17 and 18) provided on the upstream side of the sheet member 67, a downstream side member 62 (refer to also FIGS. 17 and 18) provided on the downstream side of the sheet member 67, and an opposed member 63 (refer to also FIG. 17) which forms a path surface opposed to the sheet member 67 on the transport path T shown in FIG. 16 is referred to as a "path forming member".

By providing the "path forming member" in the vicinity of the sheet member 67, it is possible to suppress the charging of the paper, to enable the stable paper transport, and to further suppress the charging of the reading surface 52*a*.

In addition, since the paper dust can be adsorbed by the "path forming member" after the paper has passed through the "path forming member", it is possible to reduce the possibility of paper dust adhering to the sheet member 67.

In addition, if the sheet member 67 is charged, the window portion 66 provided on the scanner unit 64 side may be charged. The static electricity of the charged window portion 66 may affect reading performance of the reading unit 52. In order to suppress the influence of the charged sheet member 67 on the reading unit 52, although a conductive double-sided tape may be used for attaching the window portion 66 in the scanner unit 64, in the embodiment, since the charging of the sheet member 67 is suppressed by the "path forming member", the use of the conductive double-sided tape can be omitted. Therefore, manufacturing cost can be reduced.

In addition, the disclosure is not limited to the above embodiment, and it is needless to say that various modifications are possible within the scope of the disclosure described in the claims, and these are also included within the scope of the disclosure.

What is claimed is:

1. A medium processing apparatus comprising:

a transport unit that transports a medium;

a transport path through which the medium being transported by the transport unit passes;

a processing unit that performs predetermined processing on the medium on the transport path;

a path forming member that forms at least a portion of the transport path; and a medium placement unit on which the medium fed toward the processing unit by the transport unit is placed, wherein a surface resistance value of the path forming member changes according to an applied voltage of the medium, and wherein the path forming member forms at least a portion of the transport path from the medium placement unit to the processing unit.

2. The medium processing apparatus according to claim 1, wherein a surface resistance value of the path forming member in a case where a first voltage is applied is larger than a surface resistance value in a case where a second voltage higher than the first voltage is applied.

3. The medium processing apparatus according to claim 1, wherein a surface resistance value of the path forming member in a case where the voltage is not applied is larger than a surface resistance value in a case where a voltage is applied.

4. The medium processing apparatus according to claim 1, wherein a surface resistance value of the path forming member in a state where the charged medium passes and does not come into contact is larger than a surface resistance value in a state where the charged medium passes while being in contact.

5. The medium processing apparatus according to claim 1, wherein a rate of change of a surface resistance value of the path forming member which increases in a case where an applied voltage is changed from a first voltage to zero is higher than a rate of change of a surface resistance value which increases in a case where the applied voltage is changed from a second voltage higher than the first voltage to the first voltage.

6. The medium processing apparatus according to claim 1, wherein the path forming member is formed of a resin material containing carbon nanotubes in a range of 2 wt % or more and less than 6 wt %.

7. A medium processing apparatus comprising:

a transport unit that transports a medium;

a transport path through which the medium being transported by the transport unit passes;

a processing unit that performs predetermined processing on the medium on the transport path; and a path forming member that forms at least a portion of the transport path, and with which the medium is in contact, wherein a surface resistance value of the path forming member changes according to an applied voltage of the medium, wherein the processing unit is a recording unit that performs recording on the medium, and the path forming member is a support member that supports the medium at a position facing the recording unit.

8. The medium processing apparatus according to claim 7, wherein a surface resistance value of the path forming member in a case where a first voltage is applied is larger than a surface resistance value in a case where a second voltage higher than the first voltage is applied.

9. The medium processing apparatus according to claim 7, wherein a surface resistance value of the path forming member in a case where the voltage is not applied is larger than a surface resistance value in a case where a voltage is applied.

10. The medium processing apparatus according to claim 7, wherein a rate of change of a surface resistance value of the path forming member which increases in a case where an applied voltage is changed from a first voltage to zero is higher than a rate of change of a surface resistance value which increases in a case where the applied voltage is changed from a second voltage higher than the first voltage to the first voltage.

11. The medium processing apparatus according to claim 7, wherein the path forming member is formed of a resin material containing carbon nanotubes in a range of 2 wt % or more and less than 6 wt %.

12. A medium processing apparatus comprising:

a transport unit that transports a medium;

a transport path through which the medium being transported by the transport unit passes;

a processing unit that performs predetermined processing on the medium on the transport path;

a path forming member that is formed of a metal having conductivity, forms at least a portion of the transport path; and a ground member that grounds the path forming member to a ground, wherein the ground member includes a relay member, and a surface resistance value of the relay member changes according to an applied voltage of the medium.

13. The medium processing apparatus according to claim 12, wherein the surface resistance value of the relay member in a case that a first voltage is applied is larger than a surface resistance value in a case that a second voltage higher than the first voltage is applied.

14. The medium processing apparatus according to claim 12, wherein the surface resistance value of the relay member in a case where the voltage is not applied is larger than a surface resistance value in a case where the voltage is applied.

15. The medium processing apparatus according to claim 12, wherein the and a surface resistance value of the relay member in a state where the charged medium passes and does not come into contact with the path forming member is larger than a surface resistance value in a state where the charged medium passes while being in contact with the path forming member.

16. The medium processing apparatus according to claim 12, wherein a rate of change of the surface resistance value of the relay member which increases in a case where an applied voltage is changed from a first voltage to zero is higher than a rate of change of a surface resistance value which increases in a case where the applied voltage is changed from a second voltage higher than the first voltage to the first voltage.

17. The medium processing apparatus according to claim 12, wherein the relay member is formed of a resin material containing carbon nanotubes in a range of 2 wt % or more and less than 6 wt %.

* * * * *